US011753833B2

(12) United States Patent
Jasinski

(10) Patent No.: US 11,753,833 B2
(45) Date of Patent: Sep. 12, 2023

(54) MODULAR FLOATING TILE, COPING AND SKIRTING SYSTEMS FOR DECKS AND STAIRS

(71) Applicant: Dexx IP Holdings, LLC, Norfolk, VA (US)

(72) Inventor: Chris Jasinski, Woodstock (CA)

(73) Assignee: CB Interests Inc., Woodstock (CA)

( * ) Notice: Subject to any disclaimer, the term of this patent is extended or adjusted under 35 U.S.C. 154(b) by 0 days.

(21) Appl. No.: 17/292,316

(22) PCT Filed: Nov. 8, 2019

(86) PCT No.: PCT/CA2019/051593

§ 371 (c)(1),
(2) Date: May 7, 2021

(87) PCT Pub. No.: WO2020/093167

PCT Pub. Date: May 14, 2020

(65) Prior Publication Data

US 2021/0396026 A1 Dec. 23, 2021

Related U.S. Application Data

(60) Provisional application No. 62/757,375, filed on Nov. 8, 2018.

(51) Int. Cl.
*E04F 19/02* (2006.01)
*E04F 19/04* (2006.01)
(Continued)

(52) U.S. Cl.
CPC ..... *E04F 19/0477* (2013.01); *E04B 1/40* (2013.01); *E04B 2001/405* (2013.01);
(Continued)

(58) Field of Classification Search
CPC .... E04B 1/40; E04B 2001/405; E04F 11/166; E04F 15/02183; E04F 15/08; E04F 19/0477
(Continued)

(56) References Cited

U.S. PATENT DOCUMENTS 4,665,667 A * 5/1987 Taylor ..... E04D 13/15 52/96
4,780,997 A * 11/1988 Taylor ..... E04D 13/155 52/96
(Continued)

FOREIGN PATENT DOCUMENTS

| | | | |
|---|---|---|---|
| CN | 204609156 | U | 9/2015 |
| WO | 2005056951 | A1 | 6/2005 |
| WO | 2005059270 | A1 | 6/2005 |

OTHER PUBLICATIONS

International Search Report and Written Opinion dated Jan. 29, 2020, in related Patent Application No. PCT/CA2019/051593 (9 pages).

*Primary Examiner* — Brian E Glessner
*Assistant Examiner* — James J Buckle, Jr.
(74) *Attorney, Agent, or Firm* — Bereskin & Parr LLP

(57) ABSTRACT

Coping and skirting systems for structural bases are described herein. The coping and skirting systems include at least one coping tile and a support structure configured to be mounted on a front surface of the structural base and to support the at least one coping tile on the structural base. The support structure is also configured to be mounted on the structural base at a selectable position that provides for a top surface of the coping tile to be level with a top surface of a field tile on the structural base.

19 Claims, 30 Drawing Sheets

(51) Int. Cl.

| | |
|---|---|
| ***E04B 1/41*** | (2006.01) |
| *E04B 1/38* | (2006.01) |
| *E04F 11/16* | (2006.01) |
| *E04F 15/02* | (2006.01) |
| *E04F 15/08* | (2006.01) |

(52) U.S. Cl.
CPC ..... *E04F 11/166* (2013.01); *E04F 15/02183* (2013.01); *E04F 15/08* (2013.01)

(58) Field of Classification Search
USPC ..... 52/179, 287.1
See application file for complete search history.

(56) References Cited

U.S. PATENT DOCUMENTS 6,606,827 B1 * 8/2003 Hoffmann ..... F21S 4/20 52/28
6,851,229 B2 * 2/2005 Inzeo ..... E04D 13/155 52/60
7,168,209 B2 * 1/2007 Heidler, Jr. ..... E04D 3/405 52/745.1
7,647,730 B1 * 1/2010 Inzeo ..... E04D 13/155 52/60
7,748,173 B1 * 7/2010 Inzeo ..... E04D 13/155 52/60
9,151,063 B2 * 10/2015 McManus ..... E04F 15/02005
10,087,636 B2 * 10/2018 Arnold ..... E04D 13/15
10,487,518 B2 * 11/2019 Anzalone, Jr. ..... E04F 19/061
10,745,911 B2 * 8/2020 Johnson ..... E04F 13/06
10,941,575 B2 * 3/2021 Raine ..... E04F 11/166
11,293,193 B2 * 4/2022 Rus ..... E04G 21/30
2003/0051428 A1 3/2003 Kay et al.
2003/0221388 A1 * 12/2003 Benedettini ..... E04F 19/061 52/716.1
2006/0150539 A1 * 7/2006 Vanhastel ..... E04F 11/163 52/179
2008/0295422 A1 * 12/2008 Neuhofer, Jr. ..... E04F 11/17 52/179
2011/0283636 A1 * 11/2011 Vanhastel ..... E04F 19/02 52/179
2013/0255171 A1 * 10/2013 Rutherford ..... E04F 13/068 52/287.1
2014/0157691 A1 * 6/2014 Putnam ..... E04F 11/116 404/34
2014/0174005 A1 * 6/2014 Richard ..... E04F 11/175 52/741.2

* cited by examiner

MODULAR FLOATING TILE, COPING AND SKIRTING SYSTEMS FOR DECKS AND STAIRS

CROSS-REFERENCE

This application claims the benefit of U.S. Provisional Application No. 62/757,375 filed on Nov. 8, 2018, the entirety of which is incorporated herein by reference.

TECHNICAL FIELD

The embodiments disclosed herein relate generally to tile-based decking and stair systems and in particular to floating field tile, modular coping and skirting systems and methods of installing modular coping and skirting systems.

BACKGROUND

Floors used for outdoor applications such as patios, steps and decks often use a free-draining top layer of stone or porcelain tiles to create a long lasting and aesthetically pleasing construction. Traditionally, building a tile floor required the tiles to be physically bonded or mounted to the structural base by the use of adhesives, mortar, or some sort of screws, clips or staples. Over the past decade, floating cement pavers or thick porcelain tiles (+1.5 cm) on a purposefully constructed structural base have become more common. When the structural base is elevated from the surrounding grade (as in the case of a deck), the edges of the floating mineral tiles are exposed. This requires that the floating tiles at the edges of the field be retained from sliding sideways. This is a common requirement for patios, decks, steps and swimming pools.

The market also demands that the structural base edge be finished in a robust and aesthetically pleasing manner. The common solution is to install a coping or skirting detail for this purpose. Traditionally, coping and skirting at the structural base edge are constructed from wood, plastic composites or traditionally mortar-set mineral based tiles. The problem is that none of these systems works well with a floating tile installation. Wood and plastic do not generally meet the quality requirements of the consumer who is making the decision to invest in a porcelain tile flooring system. Further, conventional methods of installing tile on an adhesive mortar and then grouting is difficult, slow and expensive to install and does not align well with the technical skills of professional floating floor installers. Lastly, vertically mortar setting heavy skirting tiles and special purpose profiles for coping and skirting applications require specialized tools and skills are clearly beyond most the ability of most do-it-yourselfers that might be contemplating taking on the installation of a floating mineral tile system.

Professionals that build and renovate decks are typically framers and carpenters. Generally, framers and carpenters work with wood and woodworking equipment. Working with porcelain tile requires a completely different knowledge base and tool set. Cutting some tile in a floating tile installation is to be expected, but the market needs a floating tile and modular coping/skirting system that can be consistently and efficiently installed in new construction or renovation projects of exterior decks by traditional installation professionals. Minimizing the need for cutting tiles is paramount to this requirement. This same approach and philosophy can be used successfully in renovating concrete porches and patios.

SUMMARY

According to a broad aspect a system for mounting coping tiles on a structural base is described herein. The system includes at least one coping tile and a support structure configured to be mounted on a front surface of the structural base and to support the at least one coping tile on the structural base. The support structure is configured to be mounted on the structural base to provide for a top surface of the coping tile to be level with or slightly below a top surface of a field tile on the structural base.

In some embodiments, the systems also includes one or more shims configured to be positioned between the support structure and the front surface of the structural base to space the support structure from the front surface of the structural base.

In some embodiments, the support structure includes a coping support lip configured to rest within a groove in a rear surface of the coping tile to support the coping tile on the structural base.

In some embodiments, the coping support lip extends upwardly and outwardly in a direction away from the front surface of the structural base when the support structure is mounted on the front surface of the structural base.

In some embodiments, the coping support lip is positioned on an upper portion of the support structure.

In some embodiments, the support structure includes an alignment tab extending over a top surface of the support structure.

In some embodiments, the alignment tab extends rearwardly in a direction towards the front surface of the structural base when the support structure is mounted to the structural base.

In some embodiments, the top surface of the structural base has a plurality of floating tiles mounted thereon and the alignment tab is configured to be positioned between the floating tiles and the top surface of the structural base.

In some embodiments, the system also includes at least one skirting tile, wherein the support structure is further configured to support the at least one skirting tile on the structural base.

In some embodiments, the support structure includes a skirting support lip configured to rest within a groove in a rear surface of the skirting tile to support the skirting tile on the structural base.

In some embodiments, the skirting support lip extends upwardly and outwardly in a direction away from the front surface of the structural base when the support structure is mounted on the front surface of the structural base.

In some embodiments, the skirting support lip is positioned below the coping support lip.

In some embodiments, the support structure includes a coping support member and a skirting support member, the coping support member being configured to be a separate component from the skirting support member.

In some embodiments, the support structure includes a coping support member and a skirting support member, the coping support member and the skirting support member being integral with each other.

In some embodiments, the coping support member is spaced from the skirting support member in a direction away from the front surface of the structural base.

In some embodiments, the coping support member is vertically and outwardly spaced from the skirting support member.

In accordance with a broad aspect, a support structure for mounting a coping tile on a structural base is described herein. The support structure includes an alignment tab extending over a top surface of the structural base, a coping support member coupled to the alignment tab and extending downwardly from the alignment tab and a coping support lip coupled to and extending upwardly and away from the coping support member in a direction away from a front surface of the structural base. The support structure is configured to be mounted on the structural base to provide for a top surface of the coping tile to be level with or below a top surface of a field tile on the structural base.

In accordance with a broad aspect, a method of installing a coping system on a structural base is described herein. The method includes mounting a plurality of support structures to a front surface of the structural base. Each support structure has an alignment tab configured to extend over a top surface of the structural base, a coping support member coupled to the alignment tab and extending downwardly from the alignment tab and a coping support lip coupled to and extending upwardly and outwardly from the coping support member in a direction away from a front surface of the structural base. The method also includes hanging one or more coping tiles on the plurality of brackets.

In some embodiments, mounting the plurality of support structures includes aligning each alignment tab of each support structure with an indicator line on a top surface of the structural base and mounting each support structure to the structural base when each alignment tab is aligned with the indicator line.

In some embodiments, after aligning the alignment tab with the indicator line, the method includes positioning a shim between the support structure and the structural base to space the support structure outwardly from the structural base and mounting the support structure and the shim to the structural base.

In some embodiments, the method includes, prior to aligning each alignment tab of each support structure with the indicator line on the top surface of the structural base, marking the indicator line on the tops surface of the structural base, the indicator line positioned a distance outwardly from a vertical projection of a front surface of the structural base.

In accordance with a broad aspect, a coping or skirting tile to be mounted to a structural base is described herein. The tile has a groove extending inwardly and upwardly in a rear surface of the tile to receive a lip of a bracket for mounting the tile to the structural base.

In some embodiments, the groove extends horizontally across the rear surface of the tile.

In some embodiments, the groove is vertically positioned in an upper portion of the rear surface of the tile.

Other aspects and features will become apparent, to those ordinarily skilled in the art, upon review of the following description of some exemplary embodiments.

Figure 1A:
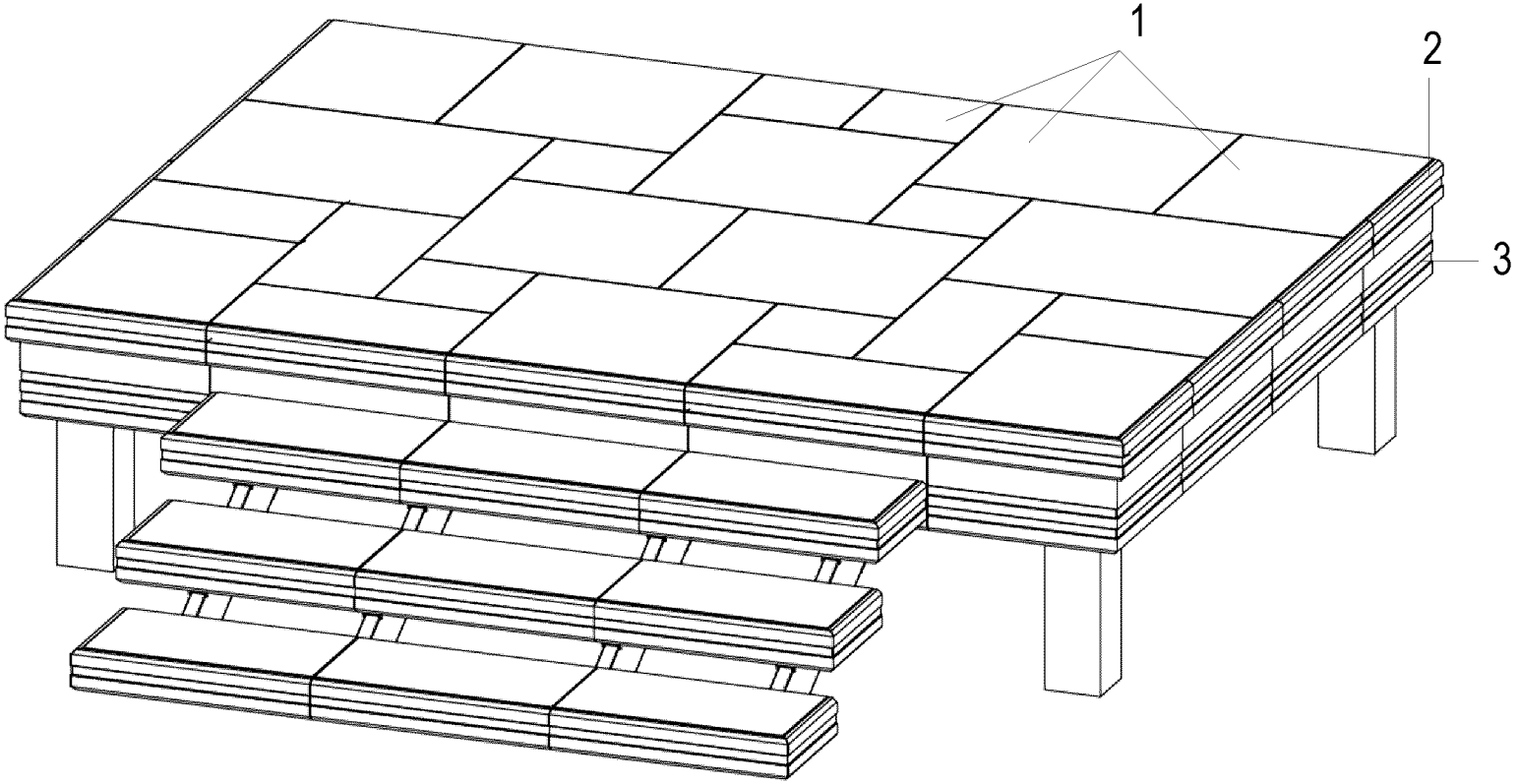
FIG. 1A is an isometric view of floating tiles installed over a deck and a stair assembly and both elements surrounded by a modular coping and skirting system, according to at least one embodiment.

The skilled person in the art will understand that the drawings, further described below, are for illustration purposes only. The drawings are not intended to limit the scope of the applicant's teachings in any way. Also, it will be appreciated that for simplicity and clarity of illustration, elements shown in the figures have not necessarily been drawn to scale. For example, the dimensions of some of the elements may be exaggerated relative to other elements for clarity. Further aspects and features of the example embodiments described herein will appear from the following description taken together with the accompanying drawings.

DETAILED DESCRIPTION

Various systems and methods will be described below to provide an example of each claimed embodiment. No embodiment described below limits any claimed embodiment and any claimed embodiment may cover systems or methods that differ from those described below. The claimed embodiments are not limited to systems or methods having all of the features of any one systems or methods described below or to features common to multiple or all of the systems or methods described below.

The systems described herein provide for floating tiles (e.g. porcelain tiles) to be placed on a top surface of a structural base and mounted on one or more side surfaces of the structural base, such as but not limited to a pressure treated deck or a concrete deck or stair treads, to substantially cover the top surface and the one or more side surfaces of the structural base.

The systems and methods described herein may be particularly directed to users that are renovating existing structural bases and wish to cover them with systems that, for instance, can withstand seasonal expansion and contraction of a wooden structural base. The systems and methods described herein are designed to provide flexibility of installation and to minimize the need to cut the floating tiles that are used to cover the top surface of the structural bases. To accomplish this, the coping and skirting systems described herein provide for vertically, laterally and outwardly adjusting the mounting position of support structures for supporting coping and/or skirting tiles on the side surfaces of a structural base to accommodate structural bases with inconsistent (e.g. irregularly shaped) starting surfaces.

For instance, in some examples, pressure-treated decks can be renovated with the systems and methods described herein. Dimensions of pressure treated decks in need of renovation can vary greatly. The length and width, thickness, flatness and squareness of field tiles and coping or skirting tiles are very consistent. Therefore, to use field tiles to cover the top surface and the side surfaces of the pressure-treated deck and be smooth (e.g. level or flat) and square, the systems and methods described herein accommodate for varying dimensions of existing structural bases.

In some embodiments, the systems and methods described herein provide for a structural base being renovated, such as a pressure treated deck, to be covered with tiles without having to remove existing deck boards. In some embodiments, the tiles to be used to cover the structural bases described herein may be of a thickness of less than about 2 inches, or less than about 1.5 inches, or less than about 1 inch. In these embodiments, the thickness of the tiles (and optionally any mat or pad laid between the tiles and the top surface of the structure) being less than about two inches may provide for the top surface of the deck to be covered with tiles and not substantially increase the height of the structure. For instance, the thickness of the tiles being less than about two inches may provide for the tiles to be laid on top of the top surface of the structure and be placed underneath a door sill, or window ledge, or the like, that may overhang a portion of the structure. Further, using the systems described herein, tiles may be placed or hung on one or more side surfaces of the base structure to substantially cover the one or more side surfaces of the structure.

The systems and methods described herein may also be used with tiles mounted on one or more side surfaces of the structure to retain the tiles on the top surface of the structure. Accordingly, the tiles placed on the top surface of the structure may be "floating tiles" or "field tiles". Herein, the term "floating tiles" generally refers to tiles (e.g. ceramic, porcelain, marble, slate, faux wood, wood or the like) that are mounted or placed on a top surface of a structural base and unattached (e.g. by grout, mortar, fasteners or clips or the like) to the top surface of the structural base.

Turning to the Figures, FIG. 1A shows a perspective view of a field of floating tiles 1 installed on a top surface 5 of a structural base 4.

Figure 1B:
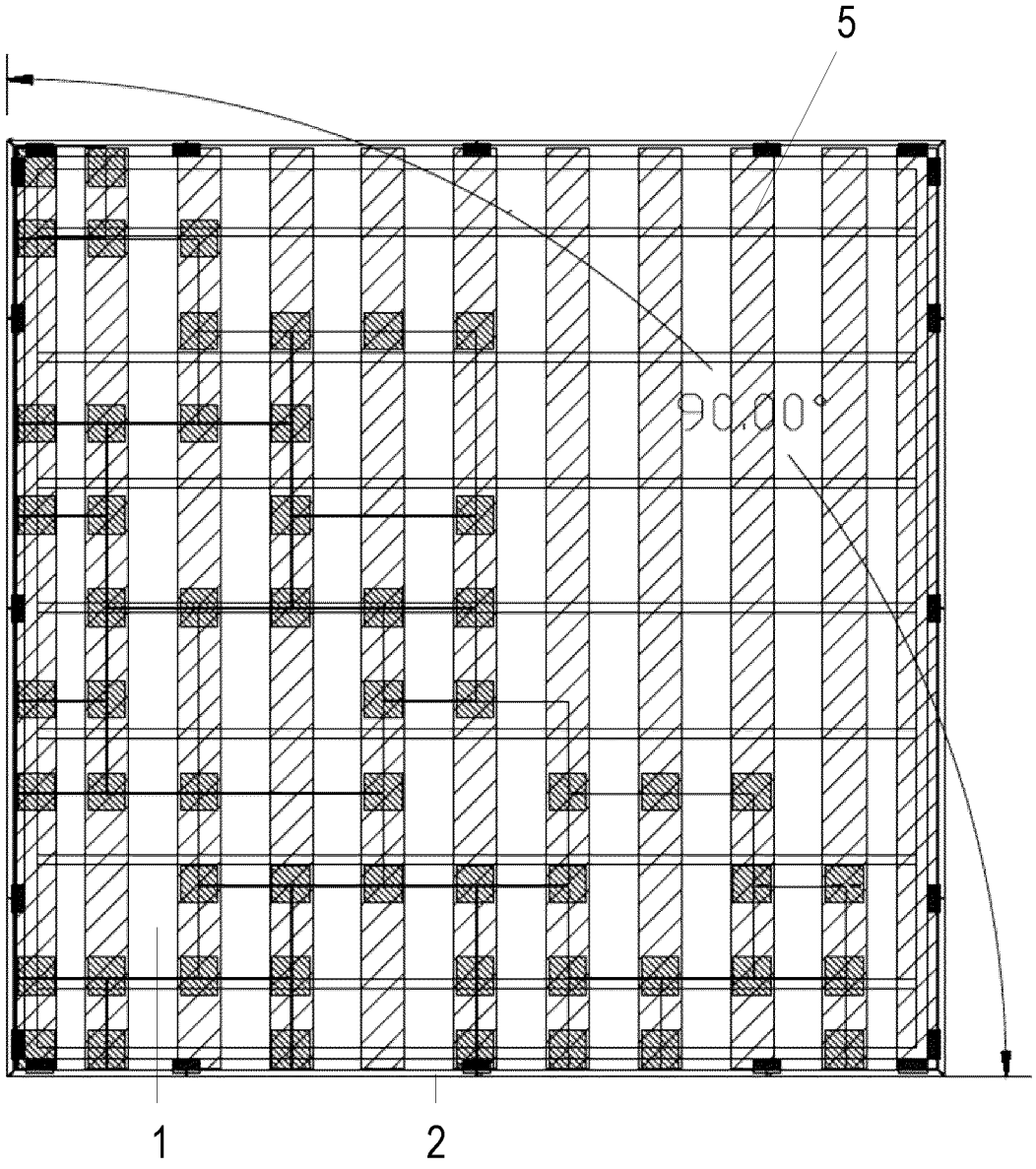
FIG. 1B is a plan view of a floating tiles with a coping border partially covering a pressure-treated deck.
Figure 1C:
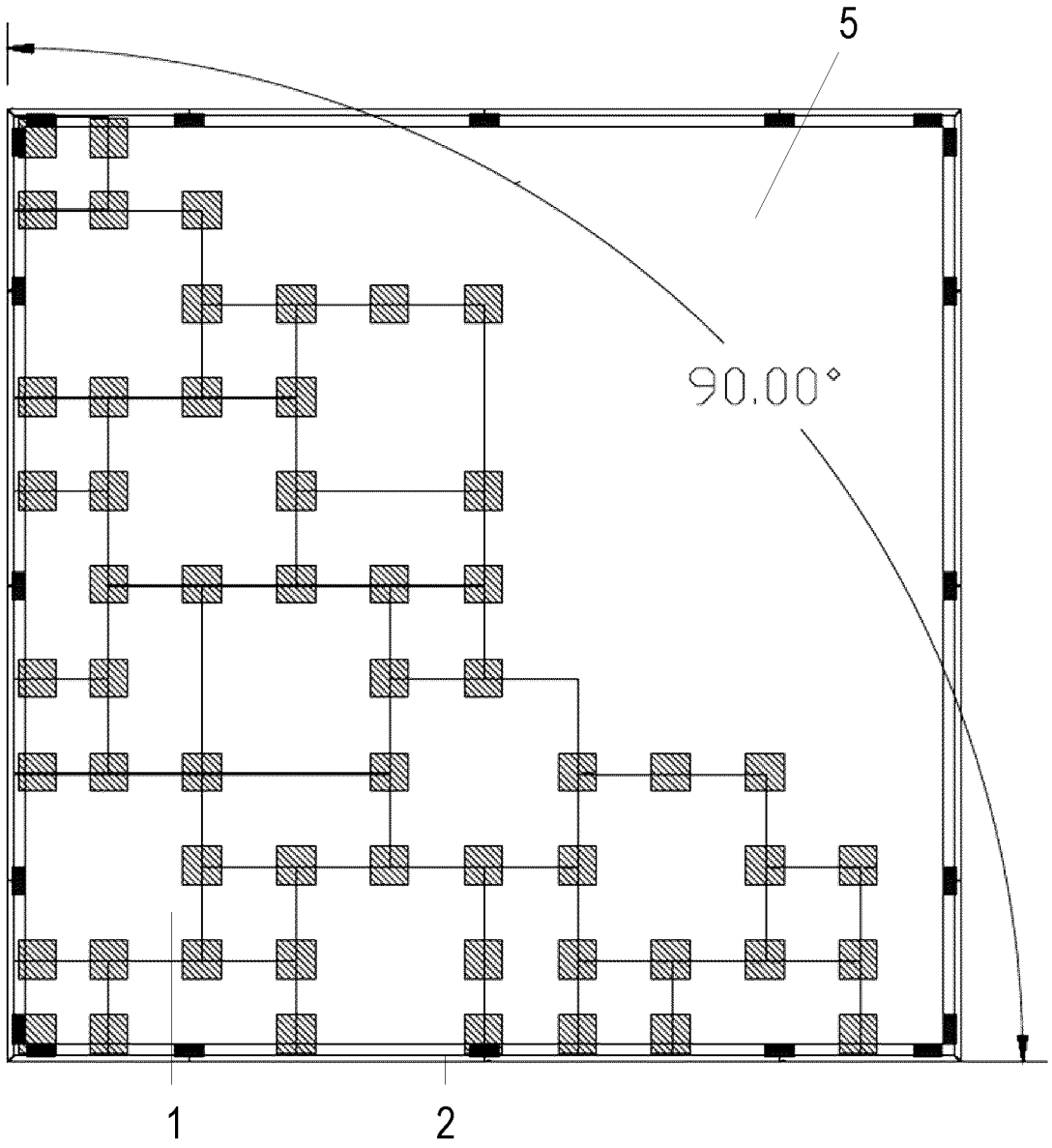
FIG. 1C is a plan view of floating tiles with a coping border partially covering a concrete patio.

Structural base 4 can be any physical structural base having a substantially level top surface and substantially vertical front or side surfaces that are appropriate for supporting floating tiles 1, coping tiles 2 and/or skirting tiles 3. For instance, in the embodiment shown in FIG. 1A, structural base 4 is an outdoor deck. Structural base 4 may also be another outdoor structure such as but not limited to one or more stair treads, a patio, a porch, a balcony or the like. Structural base 4 may also be an indoor structure such as but not limited to a hearth, a counter, indoor stairs, or the like. FIG. 1B shows a top view of floating tiles and a coping and skirting system described herein partially covering a pressure treated deck. FIG. 1C shows a top view of floating tiles and a coping and skirting system described herein partially covering a concrete patio.

Figure 2:
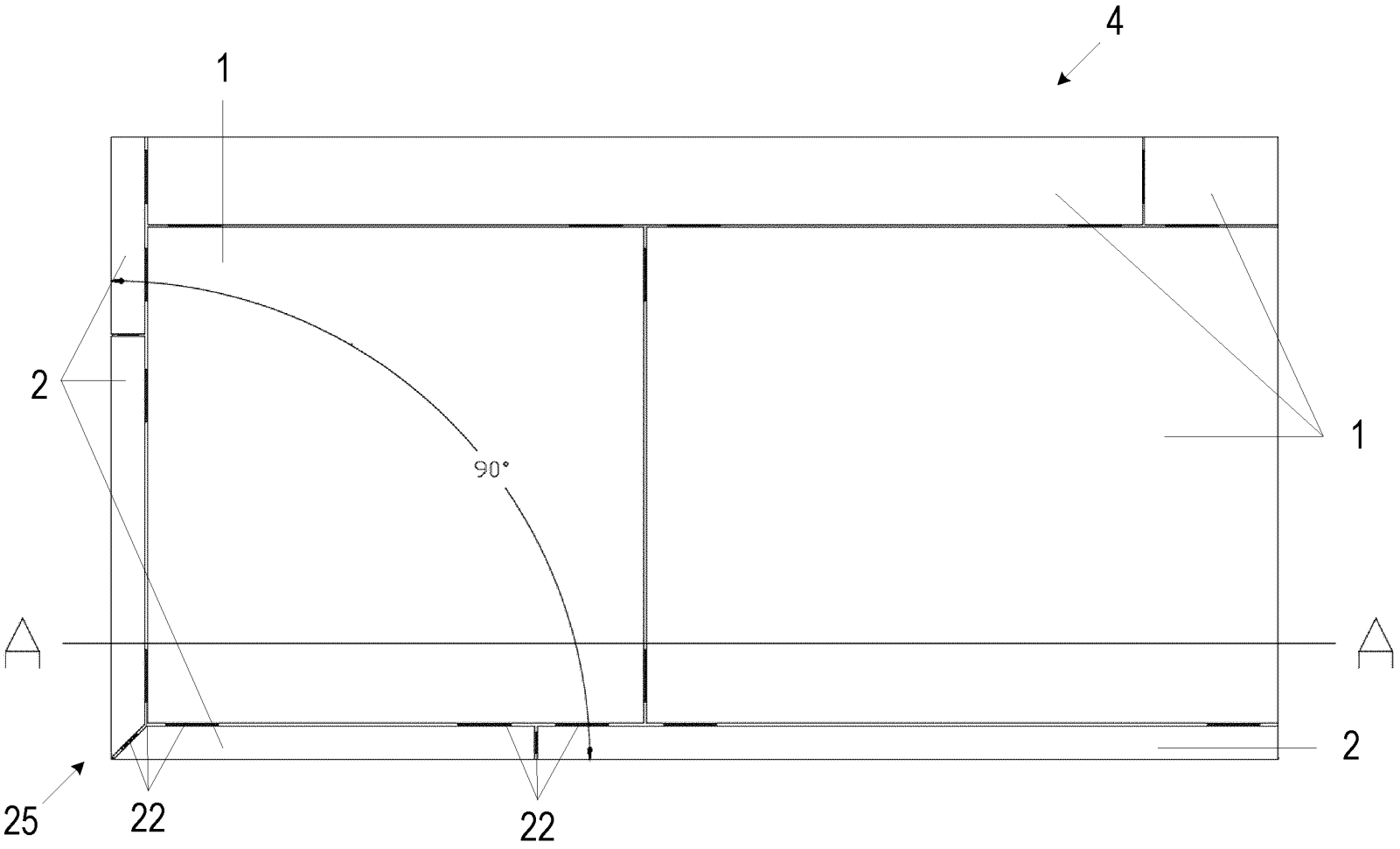
FIG. 2 is a magnified top view of the deck and modular coping and skirting system of FIG. 1 showing an interaction between coping tiles and floating floor tiles and tile spacers at a corner of the structural base.

In the embodiments described herein, floating tiles 1 are generally surrounded by a modular coping and skirting system 100. For simplicity, the term "modular coping and skirting system" is used synonymously herein with "modular coping system" and "modular skirting system". FIG. 2 shows a magnified top view of a skirting tiles 3 and a modular coping and skirting system 100, according to one embodiment.

The modular coping and skirting system 100 shown in FIG. 2 includes one or more support structures (e.g. coping and skirting brackets of CS brackets), as described below, for mounting at least one coping tile 2 and/or at least one skirting tile 3 to one or more vertical surfaces (e.g. front surfaces) of the structural base 4. The modular coping and skirting system 100 together with floating tiles 1 provide a structure having an overall representation of a finished installation when installed on a structural base 4.

In the coping and skirting system 100, coping tiles 2 are generally prominent and extend around the floating tiles 1 and skirting tiles 3 are generally recessed relative to the coping tiles 2. Both of the coping tiles 2 and the skirting tiles 3 may be several feet in length to generally surround the structural base 4. It should be noted that when the modular coping and skirting system 100 and the floating tiles 1 are installed, there are generally no fasteners visible.

Returning to FIG. 2, illustrated therein is a top-down view of inside edges 11 of coping tiles 2 meeting outer edges of the floating tiles 1 in a corner of the floating tiles 1 and coping tiles 2 shown in FIG. 1. The coping tiles 2 and floating tiles 1 may have small gaps between them for tile spacers 22. At the corner intersection 25, coping tiles 2 may be mitered (e.g. with a miter saw) to fit together. Generally, the floating tiles 1 are spaced apart from each other and from neighboring coping tiles by tile spacers 22.

Figure 3A:
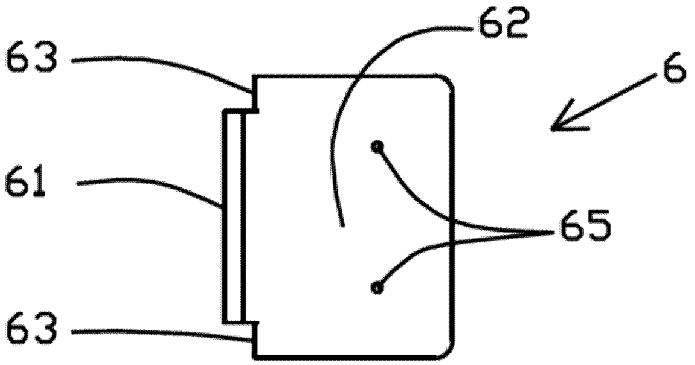
FIGS. 3A to 3C are top, front and side views, respectively, of a coping bracket of a modular coping and skirting system, according to at least one embodiment.
Figure 3C:
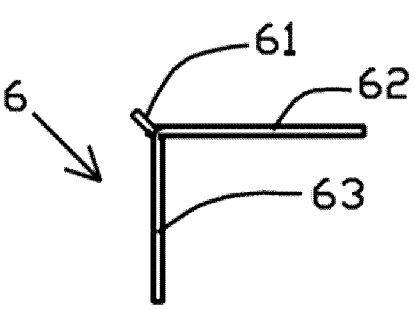
Figure 3B:
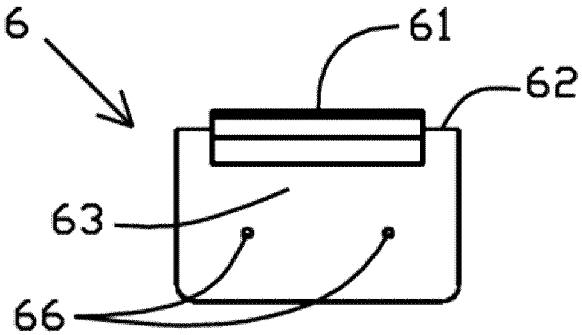

FIGS. 3A to 3C are top, front and side views, respectively, of a support structure (e.g. coping bracket) 6 according to one embodiment. Coping bracket 6 is configured to be mounted on top surface 5 of the structural base 4 (e.g. on existing deck boards. In this embodiment, it may be difficult to vertically adjust a position of the coping bracket 6.

Coping bracket 6 includes a mounting portion 62 for mounting the coping bracket 6 to top surface 5 of the structural base 4. In the embodiment shown in the FIGS. 3A to 3C, the mounting portion 62 is generally a planar portion that rests against top surface 5 of the structure 4. Mounting portion 62 may be sized and shaped to support a floating tile 1. Mounting portion 62 may include one or more openings 65 for receiving fasteners such as screws, bolts or the like, for mounting the coping bracket 6 to the top surface 5 of the structure 4. Referring to FIGS. 3B and 3C, coping bracket 6 also includes a depending portion 63 coupled to the mounting portion 62 and extending downwardly from the mounting portion 62. Depending portion 63 extends downwardly from the mounting portion 62 to support a coping tile 2 attached thereto by an adhesive, fasteners inserted through mounting holes 66 or other suitable means. Coping tile 2 can retain a floating floor tile 1 placed over top of mounting portion 62 and inhibit the floating floor tile 1 from sliding horizontally off of the top surface 5 of structure 4. Floating tile 1 can also overhang over at least a portion of the side of the structural base 4 (e.g. extend past an axis extending upwardly from front surface 51) and the skirting tile 3. In the embodiment shown in the figures, depending portion 63 extends downwardly (e.g. extends downwardly beyond an axis extending horizontally from the top surface 5 of structure 4) from mounting portion 62 in a direction parallel to and spaced apart from front surface 51 of the structural base 4.

Coping bracket 6 also includes at least one coping support lip 61 extending from the depending portion 63 in a direction upwardly and outwardly from the front surface 51 of the structural base 4. In the embodiment shown in the drawings, coping support lip 61 extends upwardly from front surface 51 of the structural base 4 to horizontally support a coping tile hung thereon. As noted above, the coping support lip 61 is sized and shaped to co-operate with groove 21 extending inwardly from a back surface of a coping tile to support the coping tile.

Figures 4A, 4B, 4C:
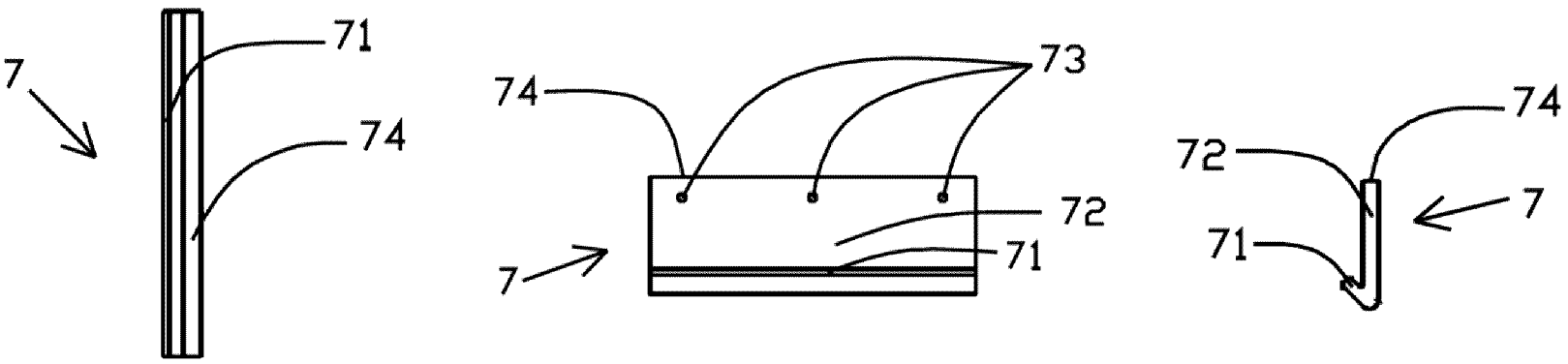
FIGS. 4A to 4C are top, front and side views, respectively, of a skirting bracket of a modular coping and skirting system, according to at least one embodiment.

Referring now to FIGS. 4A to 4C, illustrated therein are top, front and side views, respectively, of a support structure (e.g. skirting bracket) 7 according to one embodiment.

Skirting bracket 7 includes a body 72 and a skirt support lip 71. Body 72 is generally planar and mountable to front surface 51 of the structural base 4. In the embodiment shown in the drawings, skirt support lip 71 is integral with body 72 and extends away from the body 72 in a direction upward and away from the front surface 51 of the structure 4. Body 72 may include one or more openings 73 for receiving fasteners such as screws, bolts or the like for mounting the body 72 to front surface 51.

Figure 5A:
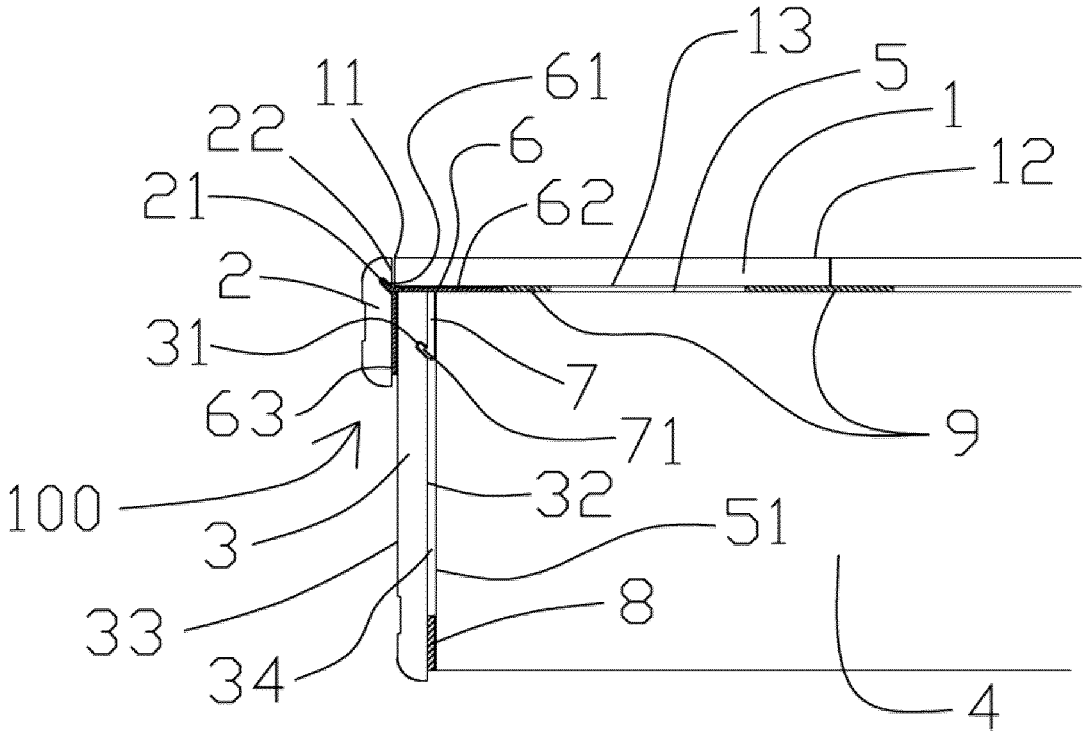
FIG. 5A is a cross-section view of the structural base and modular coping and skirting system of FIG. 2 along line A-A showing the components of the modular coping and skirting system shown therein.

FIG. 5A shows a side view of structural base 4 covered with filed tiles 1, coping tiles 2 and skirting tiles 3 using the coping bracket 6 of FIGS. 3A-3C and the skirting bracket 7 of FIGS. 4A to 4C. As seen in FIG. 5A, the coping and skirting system 100 may also include a levelling spacer 8 mountable to the front surface 51 of the structure 4. Levelling spacer 8 is spaced apart from the skirting bracket 7 and may have a thickness that is similar to the thickness of the body 72 of the skirting bracket 7.

Coping bracket 6 and skirting bracket 7 may be made of any durable metal and/or plastic material. Each of coping bracket 6 and skirting bracket 7 may be manufactured from a single piece of material, extruded, cast or folded or bent to form the individual brackets.

Figure 5B:
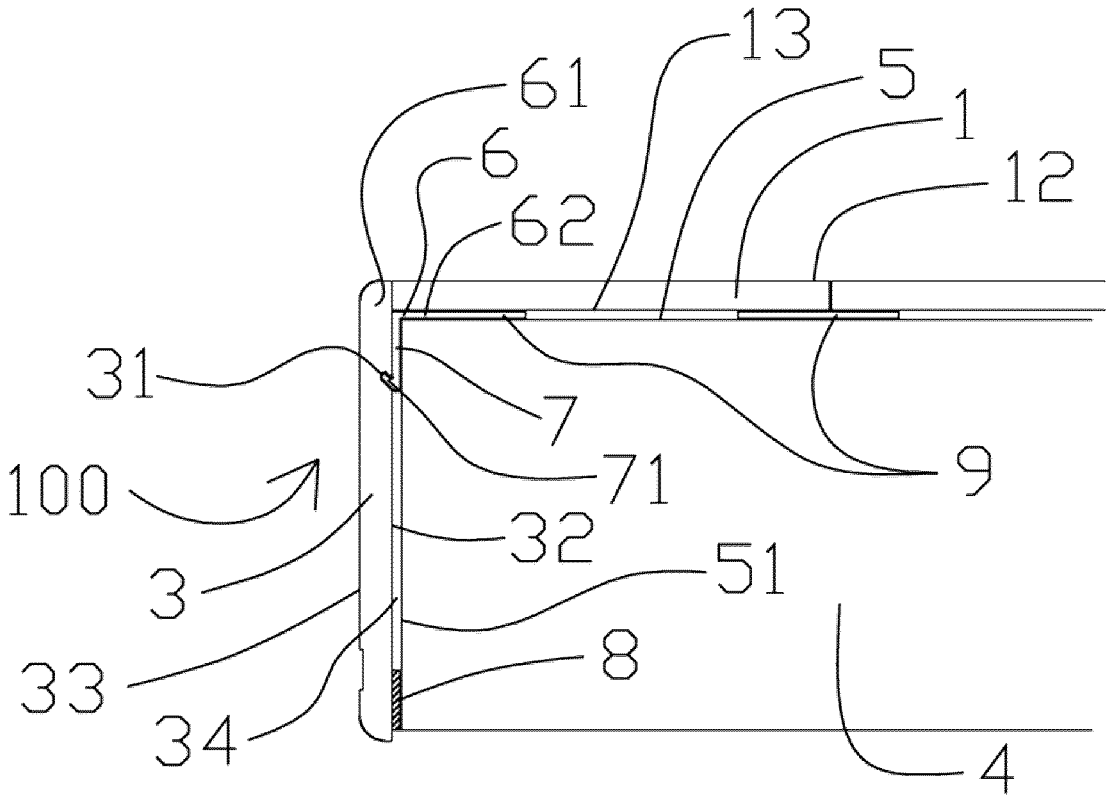
FIG. 5B is a cross-section view of a structural base and a modular skirting system showing components of the modular skirting system, according to at least one embodiment.

FIG. 5B shows a side view of a structural base 4 having a skirting bracket 7 for mounting a skirting tile 3 to structural base 4.

Figure 6A:
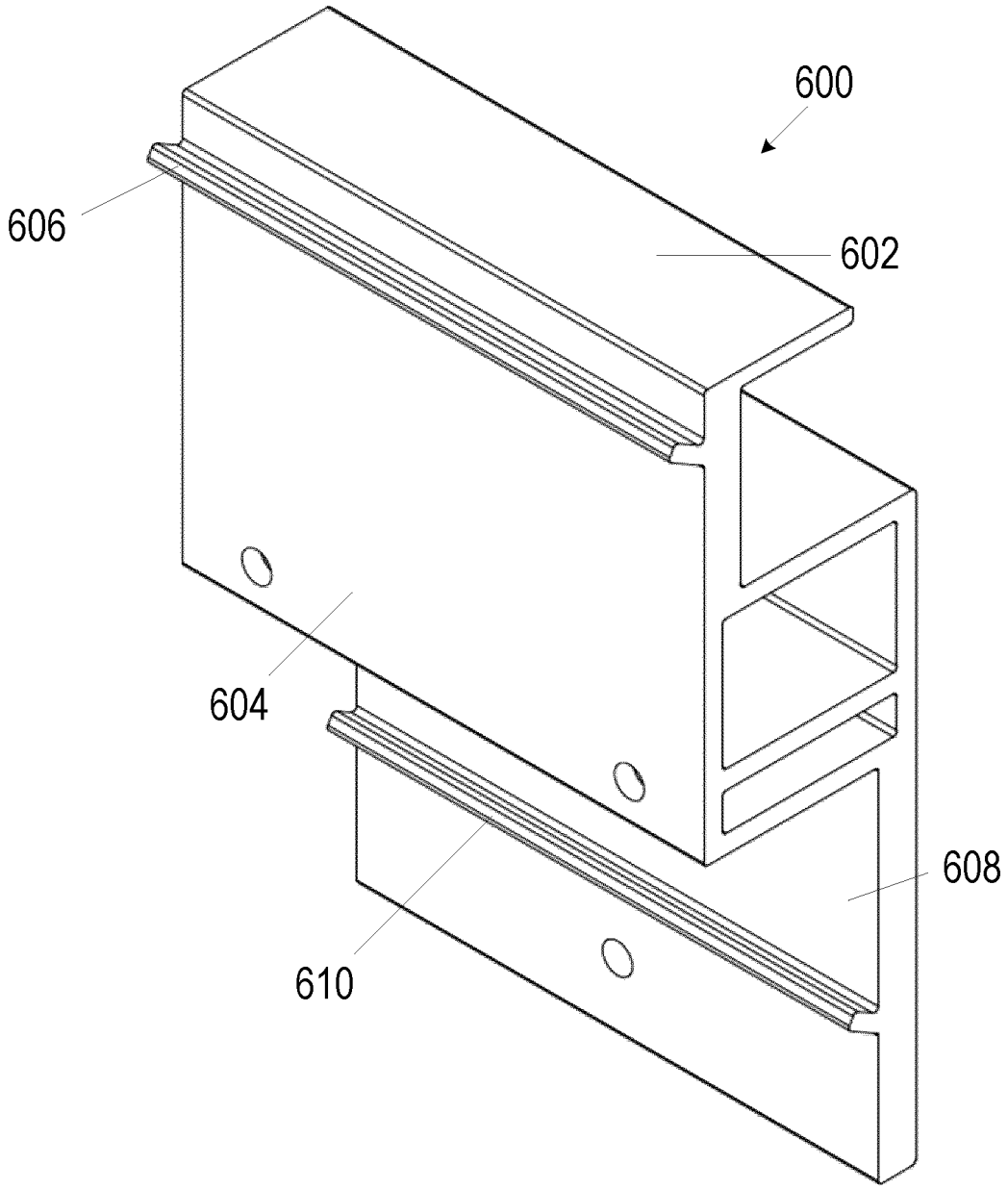
FIGS. 6A to 6C are isometric, side and rear views, respectively, of a coping and skirting support structure (i.e. CS bracket) for a modular coping and skirting system described herein, according to one embodiment.
Figure 6C:
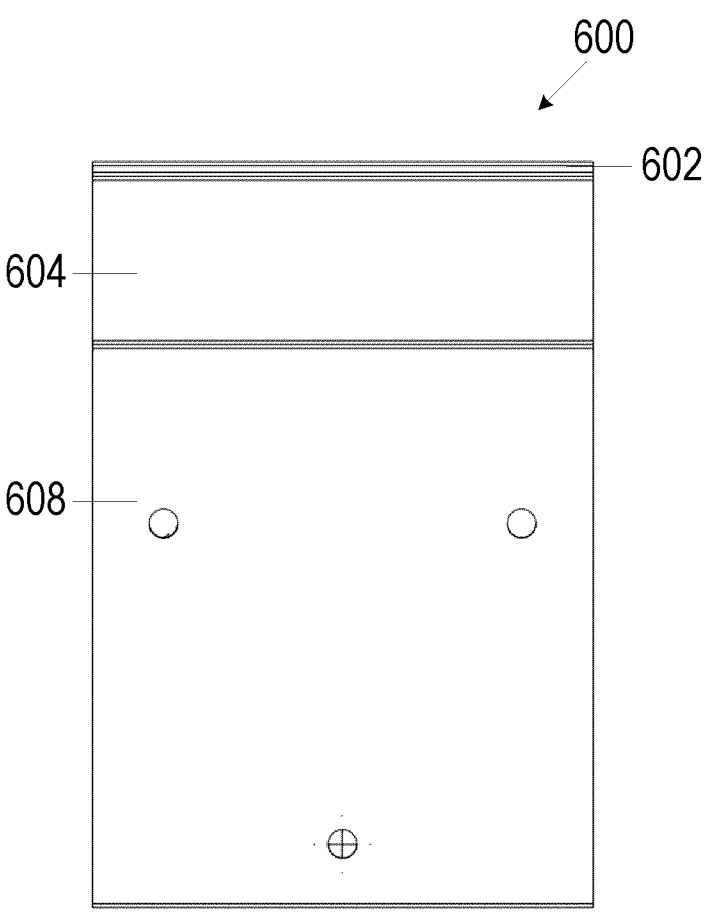
Figure 6B:
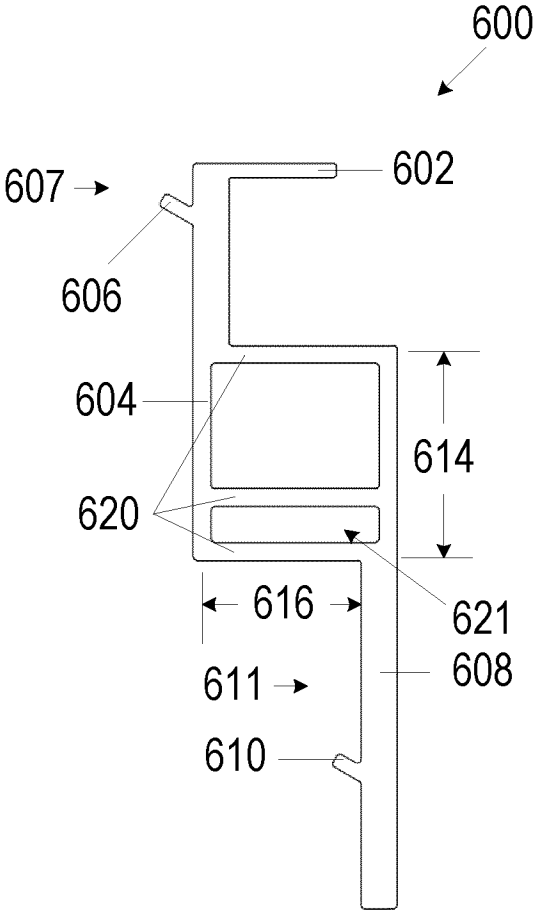

FIG. 6A to 6C show another embodiment of a support structure (e.g. CS bracket) 600 for mounting coping and skirting tiles to a structural base. CS bracket 600 is generally a rigid combination bracket that supports both coping tiles and skirting tiles on a common support structure which is mounted to front surface 51 of support structure 4.

In some embodiments, CS bracket 600 is configured to be mountable to a structural base at a selectable position. The position is selectable because CS bracket 600 is configured to be mounted to the structural base at a position that is vertically, laterally and outwardly adjustable to accommodate dimensions of the structural base 4 and provide for a top surface of a coping tile supported by the CS bracket 600 to be essentially level with or slightly below a top surface of a field tile on the structural base.

In the embodiment shown in FIGS. 6A to 6C, CS bracket 600 includes an alignment tab 602, a coping support member 604, a coping support lip 606, a skirting support member 608 and a skirting support tab 610.

Alignment tab 602 extends over a top surface of the structural base (see FIGS. 8A to 8C) when CS bracket 600 is mounted on a front surface of the structural base. Alignment tab 602 provides for positioning the CS bracket 600 on the structural base. For instance, as described in greater detail below, alignment tab 602 can be aligned with an indicator (e.g. chalk line, string line, laser line, etc.) on a top surface of the structural base to provide for the CS bracket 600 (e.g. coping lip 606) to be vertically positioned such that a coping tile mounted thereon is positioned so that the top surface of the coping tile is level or slightly below a top surface of field tiles 4 on the top surface of the structural base. Similarly, CS bracket 600 may be positioned to provide for a top surface of a coping tile thereon to be aligned (e.g. coplanar) with a top surface of neighboring coping tiles.

Coping support member 604 extends downwardly from the alignment tab 602 and is spaced apart from the front face of the structural base. As noted above, generally, coping tiles extend outwardly from a front surface of a structural base at a distance that is greater than a distance that skirting tiles extend outwardly from the front surface of the structural base.

Coping support lip 606 extends outwardly from the coping support member 604. In the embodiment shown, coping support lip 606 extends outwardly and upwardly from the coping support member 604 in a direction away from the front surface of the structural base. Further, in the embodiment shown in the drawings, the coping support lip 606 is positioned on an upper portion (i.e. above a midline) 607 of the coping support member 604 and is configured to be received in a groove in the upper rear surface of a coping tile to be mounted thereon. This allows the coping tile to hang vertically by gravity and allows for the installer to iteratively make micro adjustments to the coping tile (e.g. miter cuts) to facilitate final installation. Coping support lip 606 may extend upwardly to be received in the groove in the rear surface of the coping tile.

Skirting support member 608 extends downwardly from the coping support member 604 and may either rest against the front surface of the structural base 4 or be shimmed apart from the front surface of the structural base (e.g. up to approximately 2") in a direction away from the structural base to facilitate the squaring of the structure 4 and the installation of field tiles 1 without needing to cut the field tiles 1. Skirting support member 608 is generally positioned below the coping support member 604.

Skirting support lip 610 extends outwardly from the skirting support member 608 in a direction away from the front surface of the structural base. In the embodiment shown in the drawings, the skirting support lip 608 is positioned on an upper portion 611 (i.e. above a midline) of the skirting support member 608 and is configured to be received in a groove in a rear surface of a skirting tile to be mounted thereon. In the embodiment shown, skirting support lip 610 also extends upwardly from the skirting support member 608 to be received in the groove 31 in the rear surface of the skirting tile 3. Groove 31 is in an upper-rear portion (i.e. above a midline) of the skirting tile 3 to provide for the skirting tile 3 to hang vertically (e.g. like a picture on a wall).

Skirting support member 608 is below coping support member 604 by a distance 614 and inward of coping support member 604 by a distance 616. Between the skirting support member 608 and the coping support member 604 are bracket support members 620 extending inwardly from the coping support member 604 (see FIG. 6B). Bracket support members 620 add strength to the CS bracket 620 and provide for coping tile 2 to be outwardly spaced from the skirting tile 3 and/or the front surface 51 of the structural base 4. In some embodiments, adjacent bracket support members 620 may form a channel 621 through the CS bracket 600 for receiving one or more fasteners 82 to mount the CS bracket 600 to the structural base (see FIG. 6B).

Figure 7B:
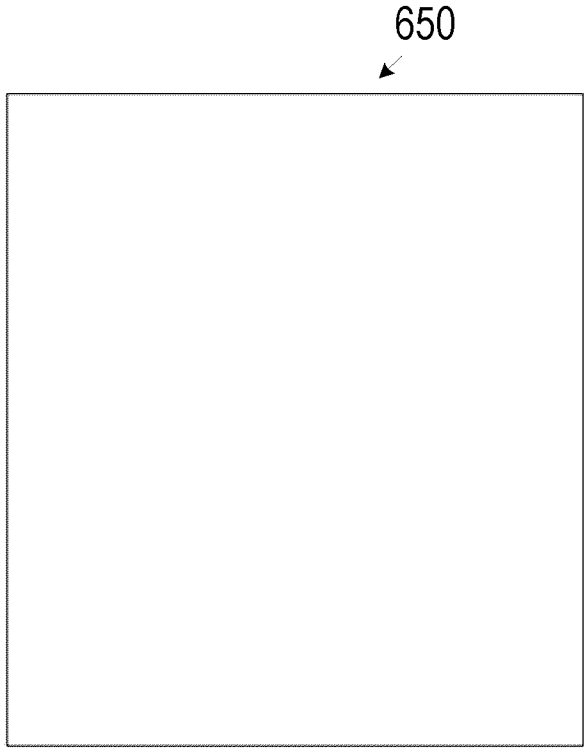
FIG. 7B is a front view of the CS bracket shims of FIG. 7A.
Figure 7A:
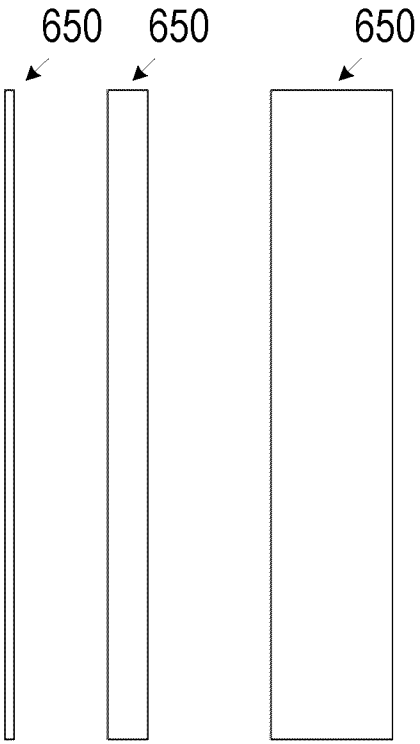
FIG. 7A shows side views of three embodiments of shims (i.e. CS bracket shims) for a modular coping and skirting system described herein.
Figure 8B:
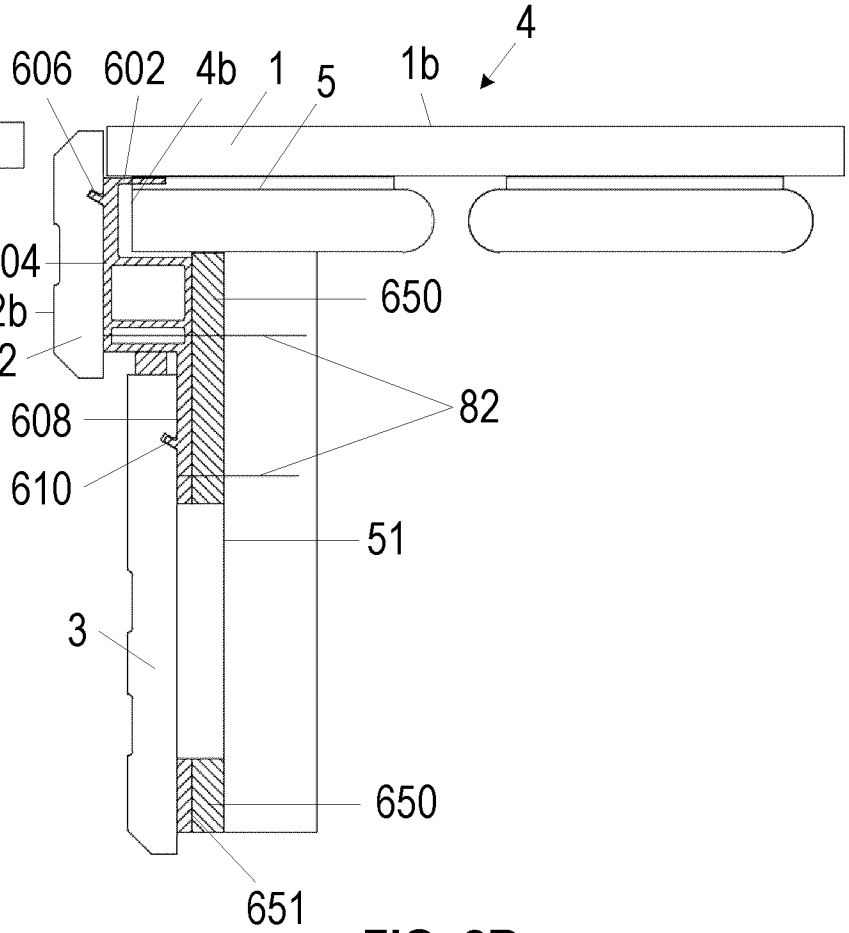
FIG. 8B is a cross-section view of a structural base and a modular coping and skirting system described herein showing components of the modular coping and skirting system including a CS bracket and a CS bracket shim, according to at least one embodiment.

FIGS. 7A and 7B show side views and a front view, respectively, of a shim 650 (e.g. CS bracket shim) for use in the systems described herein. For instance, shim 650 can be positioned between the CS bracket 600 and the front surface 51 of the structural base to space the CS bracket 600 a distance outwardly from the front surface of the structural base. An example of this is shown in FIG. 8B.

As noted above, the physical dimensions of existing structural bases may vary. Shim 650 is generally a rigid structure that may provide for adapting the systems described herein to accommodate irregularities that may exist in structural base 4 and provide a coping and skirting system that is, for example, square to the field tiles 1 on the structural base 4. In some embodiments, shims 650 may have a thickness of about ½ of an inch, about ¼ of an inch, about ⅛ of an inch, about 1/16 of an inch or the like.

CS bracket shim 650 is generally made of a rigid material (e.g. wood, plastic or a metal). In some embodiments, shim 650 can include an adhesive on one or more sides or faces thereof to provide for affixing the shim 650 to the rear surface of support member 608 of the CS bracket 600 before mounting the CS bracket 600 to the front face 51 of the structure 4, for example.

In this use, shim 650 can stacked to form a series of shims 650 with a cumulative thickness as required by the installation and to a maximum of approximately 2".

Figure 8A:
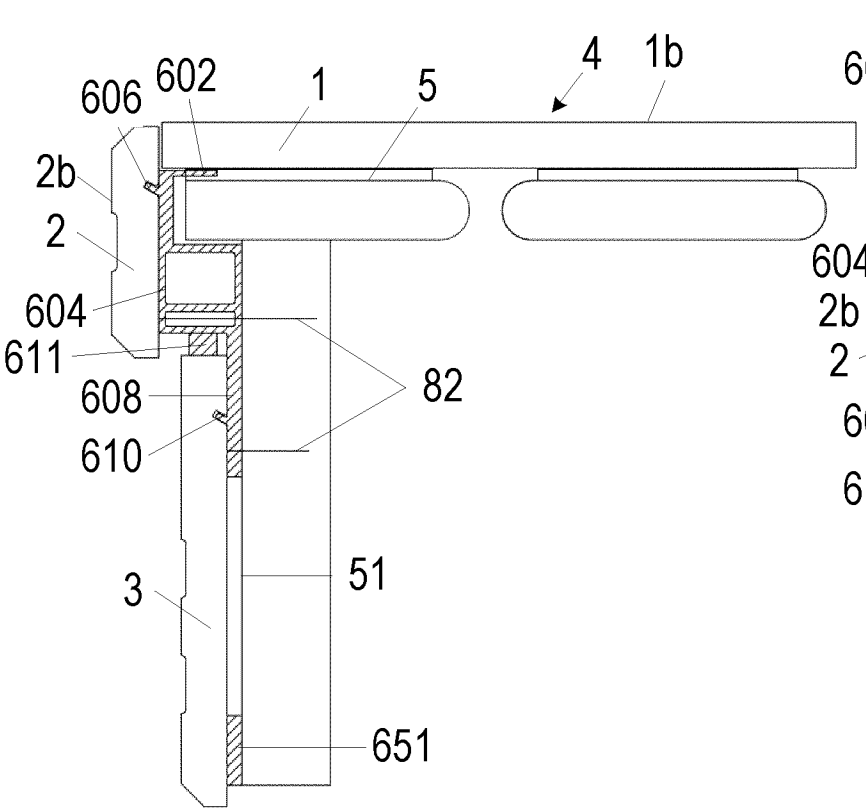
FIG. 8A is a cross-section view of a structural base and a modular coping and skirting system described herein showing components of the modular coping and skirting system including a CS bracket, according to at least one embodiment.
Figure 8C:
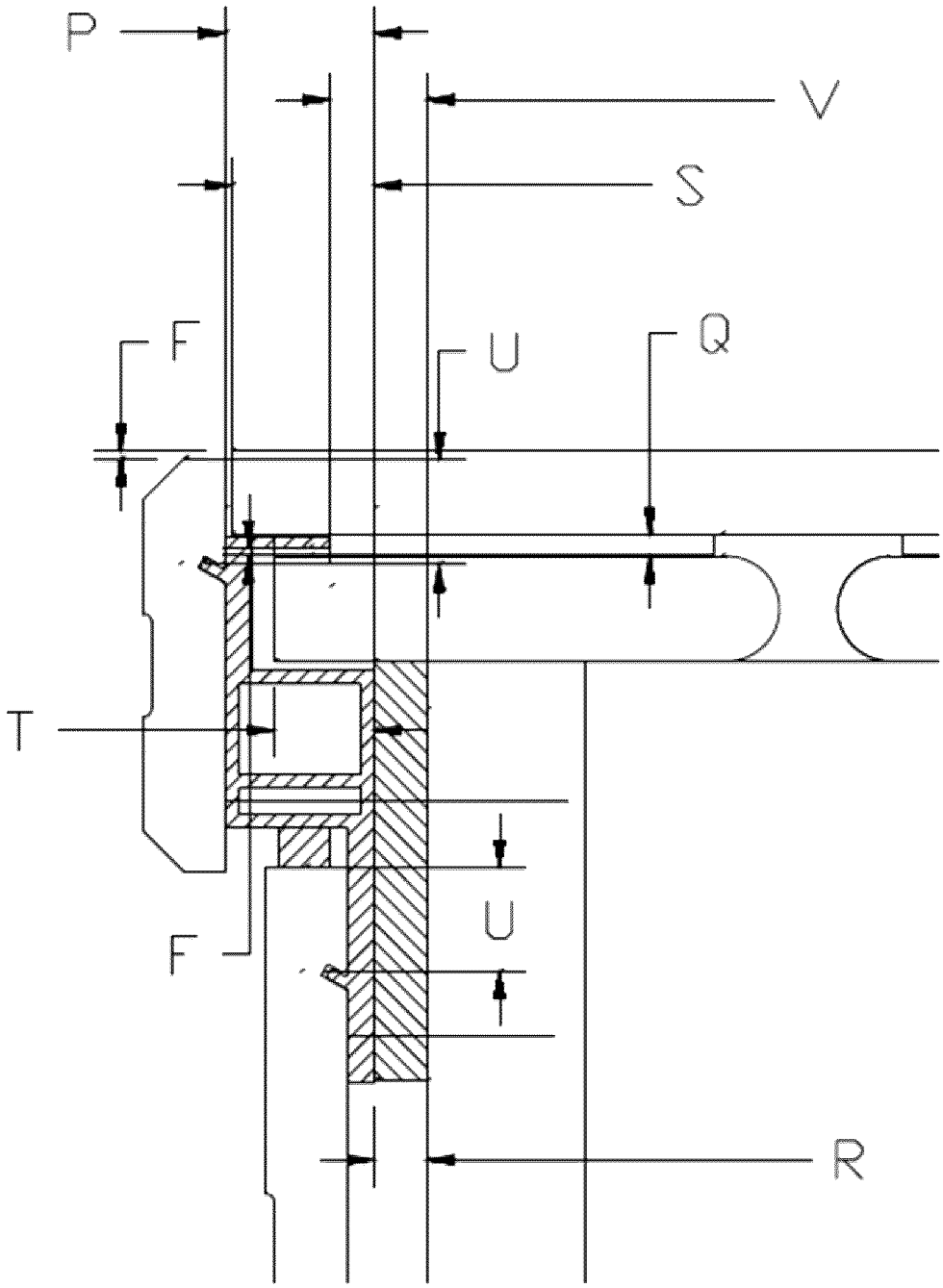
FIG. 8C is a magnified cross-section view of a structural base and a modular coping and skirting system shown in FIG. 8B showing components of the modular coping and skirting system including a CS bracket and a CS bracket shim, according to at least one embodiment.

Turning now to FIGS. 8A to 8C, illustrated there are three examples of the CS bracket 600 of FIGS. 6A to 6C being installed (e.g. mounted) on a structural base. As shown in FIG. 8A, CS bracket 600 may be mounted to front face 51 of structural base 4 adjacent a top edge 4*b* of the structural base 4 when top surface 5 of structural base 4 overhangs front face 51. Once the CS bracket 600 has been mounted on front face 51 (e.g. via one or more fasteners 82), at least one coping tile 2 may be hung on coping support lip 606 by means of a groove extending inwardly from a rear surface of a coping tile 2.

CS bracket 600 is positioned on the front face 51 of the structure 4 such that a top edge 2*b* of the coping tile 2 is about level with or below a top surface 1*b* of the floating tiles 1. For instance, top edge 2*b* of the coping tile 2 may be ⅛ of an inch below, or 1/16 of an inch below, or 1/32 of an inch below a top surface 1*b* of the floating tiles 1. Coping support lip 606 is positioned on the CS bracket 600 such that, when coping tile 2 is mounted thereon, coping tile 2 inhibits lateral movement of floating tiles 1 placed on the structure 4.

At least one skirting tile 3 may also be hung on CS bracket 600 by skirting support lip 610 by means of a groove extending inwardly and upwardly from a rear surface of a skirting tile. 3. Generally, two CS brackets 600 are used to hang each coping tile 2 and/or skirting tile 3 on a structural base 4. In some embodiments, one CS bracket 600 may be used to hang each coping tile 2 and/or skirting tile 3 on a structural base 4.

In FIG. 8B, CS bracket 600 is mounted to front face 51 of the structure 4 (e.g. by one or more fasteners 82) and a CS bracket shim 650 is placed between the CS bracket 600 and front face 51 of the structure 4. CS bracket shim 650 is configured to space the CS bracket 600 from the front face 51 of the structure 4 by a distance. It should be understood that one or more CS bracket shims 650 can be positioned between the CS bracket 600 and front surface 51 of structural base 4 to control the distance between the front face 51 of the structural base 4 and a rear surface of the CS bracket 600. It should also be noted that a thickness of each shim 650 can be distinct for each bracket 600 and that the overall purpose of shims 650 is to adjust the position of bracket 600 to align a position of each coping member 604 and each skirting member 608, and lips 606 and 610, of CS brackets 600 on a structural base 4 so that the coping tiles 2 and skirting tiles 3 are correctly positioned with respect to outermost edges and the top surface 5 of the field tiles 1.

As shown in FIGS. 8A and 8B, CS bracket 600 may be configured to receive one or more fasteners 82 to be coupled to the front face 51 of structure 4. In some embodiments, CS bracket 600 may be configured to receive a fastener 82 at a position between the coping support lip 606 and the skirting support lip 610. CS bracket 600 may also be configured to receive a fastener 82 at a position below skirting support lip 600. Placing two or more fasteners 82 in the CS bracket 600 ensures the rigidity and positioning stability of CS bracket 600.

It should be noted that the embodiments shown in FIGS. 8A and 8B also include an optional block 611 and skirting spacer 651. Block 611 may be a semi-rigid material (e.g. rubber) that is installed to rest between a top surface of the skirting tile 3 and support structure 600. Block 611 may contribute to immobilizing the skirting tile 3 when installed on support bracket 660. Skirting spacer 651 may also be made of a semi-rigid material (e.g. rubber or foam) that provides for spacing a lower portion of the skirting tile 3 from the front surface 51 of structural base 4 such that skirting tile 3 is generally normal to top surface 5 of structural base 4.

Turning to FIG. 8C, a magnified cross-sectional view of CS bracket 600 being mounted on front surface 51 of structural base 4 is shown therein.

FIG. 8C illustrates a number of dimensions relating to the positioning of the support structures (e.g. CS bracket 600) described herein on structural base 4. For instance, as shown therein, distance F refers to a difference in heights of the top surface 1*b* of field tile 1 and top surface 2*b* of coping tile 2. Generally, it is preferred to position coping tile 2 on support structure 600, and to position support structure 600 on structural base 4, such that top surface 2*b* of coping tile 2 is lower than or level with top surface 1*b* of field tile 1. Positioning top surface 2*b* of coping tile 2 to be lower than or level with top surface 1*b* of field tile 1 may reduce a risk of impact and/or weight bearing on the coping tile 2 by a person walking thereon (see FIG. 11).

Related to distance F, distance Q refers to a distance between top surface 5 of the structural base 4 and a bottom surface of the field tiles 1 (which is approximately equal to a thickness of a mat structure to be placed between the filed tiles 1 and the top surface 5 of the structural base 4). Distance F subtracted from distance Q provides a thickness of the alignment tab 602 of the CS bracket 600. Again, as noted above, the physical dimensions of existing structural bases 4 may vary. The thickness of the alignment tab 602 provides for adjusting a vertical position of the CS bracket 600 on the front face 51 of the structural base 4.

Distance U is a height from a top surface 5 of the field tiles 4 to coping support lip 606. U is also a height from a top surface of the skirting tile 3 to skirting support lip 610.

Distance S is a distance between a front surface of the field tile 1 and a rear surface of the CS bracket 600. Similarly, P is a distance between a front surface of the CS bracket 600 and a rear surface of the CS bracket 600. Accordingly, the difference between the distances P and S is the distance of a gap between the rear surface of the coping tile 2 and a front surface of the field tile 1.

Distance V is a distance between an indicator line on the top surface 5 of the structural base 4 and a vertical projection of the front surface 51 of the structural base.

Distance R is a distance between a rear surface of the CS bracket 600 and a front surface of the structural base. Distance R generally corresponds to a thickness of one or more shims 650.

Distance T is a distance from a front surface 51 of the structural base 4 to a vertical projection of top edge 4*b* (see FIG. 8B) of the structural base 4.

References to these dimensions will be made in FIGS. 13 and 14, below.

To install CS bracket 600 on a structural base 4, one or more fasteners 82 are used to affix the CS bracket 600 to front surface 51 of the structural base 4 when the indicator tab 602 is aligned with an indicator line on a top surface 5 of the structural base 4 (as described further below) and the CS bracket 600 is vertically positioned to provide for distance F to be 0 or greater than 0 (i.e. for top surface 2*b* of the coping tile 2 to be lower than or about level with top surface 1*b* of field tile 1). Generally, each CS bracket 600, for example, should be positioned on the structural base to provide for distance F to be consistent for each of the CS brackets 600 on the structural base 4 to provide for the field tiles 1 and the coping tiles to be consistently positioned.

Figures 9A, 9B, 9C:
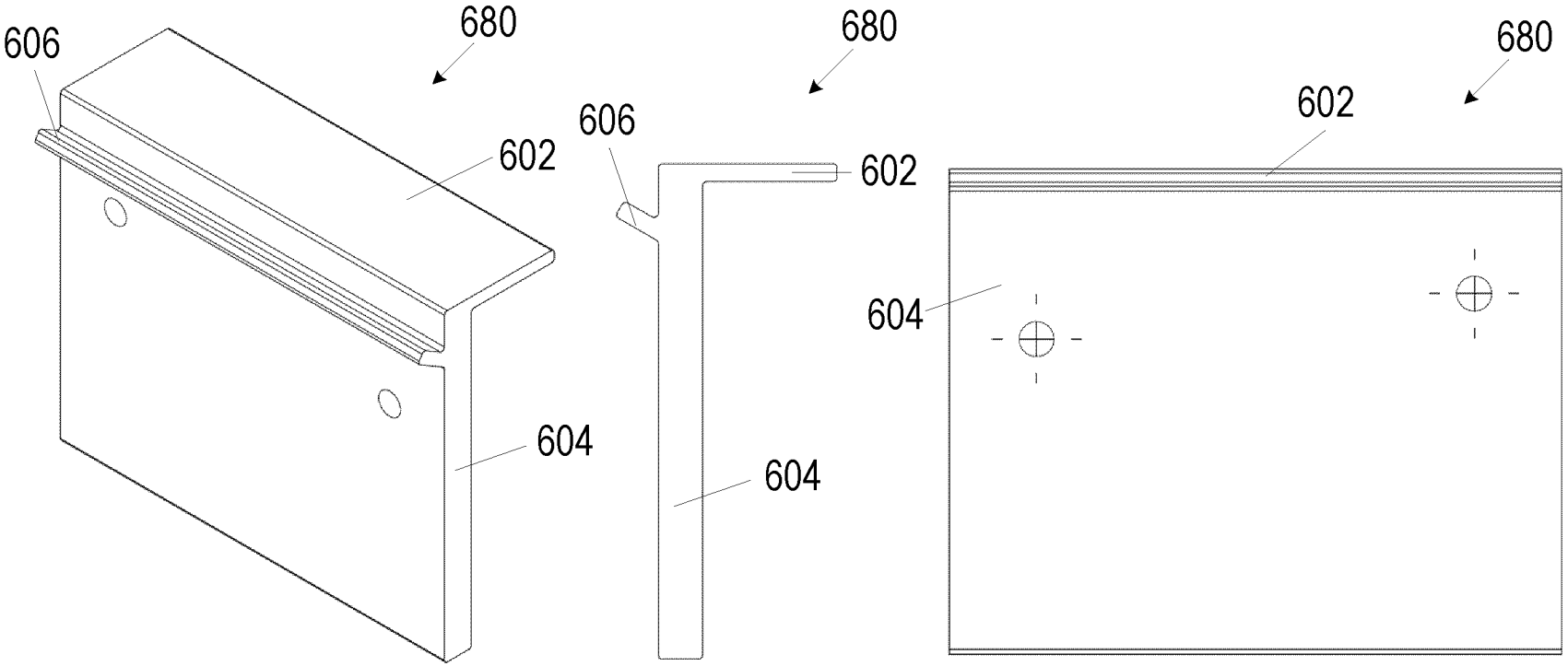
FIGS. 9A to 9C show isometric, side and rear views, respectively, of a support structure for a coping or skirting system described herein, according to at least one embodiment.

Another embodiment of a coping or skirting bracket 680 is shown in FIGS. 9A to 9C. Bracket 680 is modeled from the top portions (602, 604 and 606) of CS bracket 600 to facilitate the installation of only a coping tile 2 or a skirting tile 3. Bracket 680 therefore includes an alignment tab 602, a coping support member 604 and a coping support lip 606 as previously described. In some embodiments, bracket 680 can be used for mounting coping tiles 2 or skirting tiles 3 to stair treads (see for example FIG. 11).

As previously described with reference to FIGS. 6A to 6C, alignment tab 602 of bracket 680 extends over a top surface of the structural base 4 when bracket 680 is mounted on a front surface 51 of the structural base 4. Alignment tab 602 provides for positioning the bracket 680 on the structural base.

As also previously described with reference to FIGS. 6A to 6C, coping support member 604 of bracket 680 extends downwardly from the alignment tab 602 and is spaced apart from the front face 51 of the structural base 4 when installed. As noted above, generally, coping tiles 2 extend outwardly from the front surface 51 of structural base 4 at a distance that is greater than a distance that skirting tiles 3 extend outwardly from the front surface 51 of the structural base 4.

Coping support lip 606 of bracket 680 also extends outwardly from the coping support member 604. In the embodiment shown, coping support lip 606 extends upwardly and outwardly from the coping support member 604 in a direction away from the front surface of the structural base.

Figure 9D:
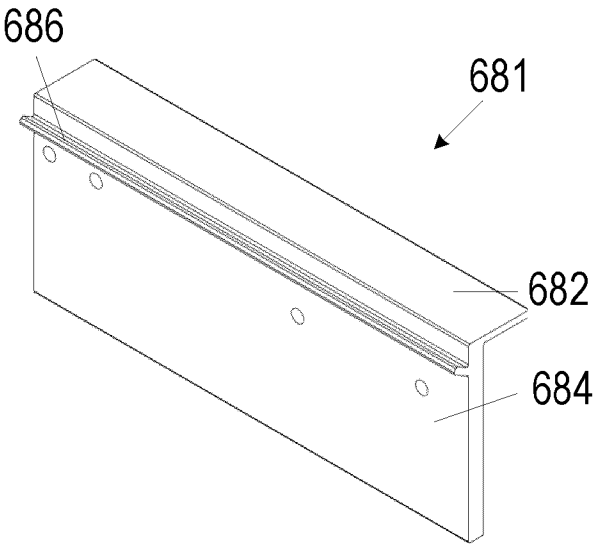
FIGS. 9D to 9F show isometric, side and rear views, respectively, of another support structure for a coping or skirting system described herein, according to at least one embodiment.
Figure 9F:
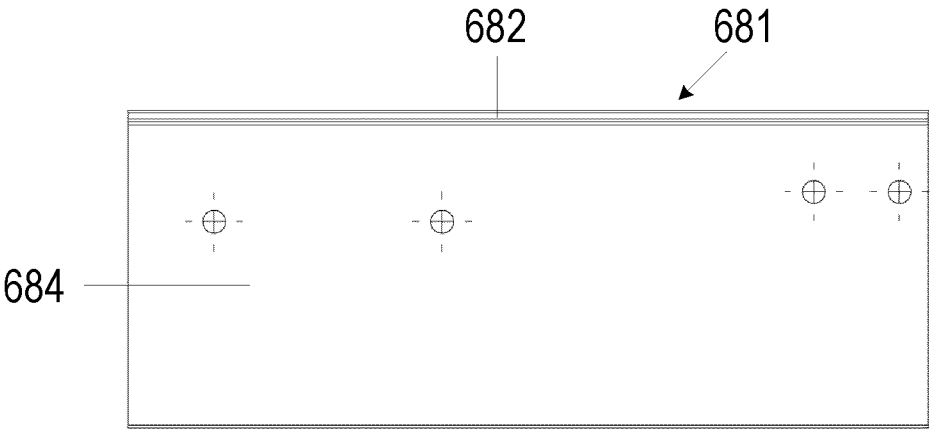
Figure 9E:
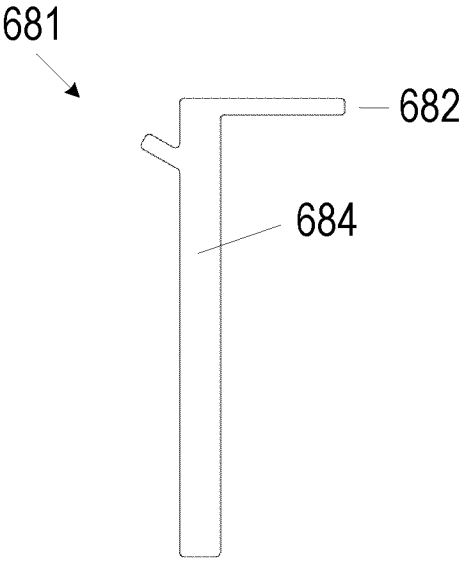

FIGS. 9D to 9F show another embodiment of a coping bracket 681 having a width greater than the width of the coping bracket 680 shown in FIGS. 9A to 9C. In some embodiments, the coping bracket 680 of FIGS. 9A to 9C may be appropriate for use on an end (e.g. short side) of a stair tread whereas the coping bracket 681 of FIGS. 9D to 9F may be appropriate for use on a side (e.g. long side) of a stair tread.

Figure 10A:
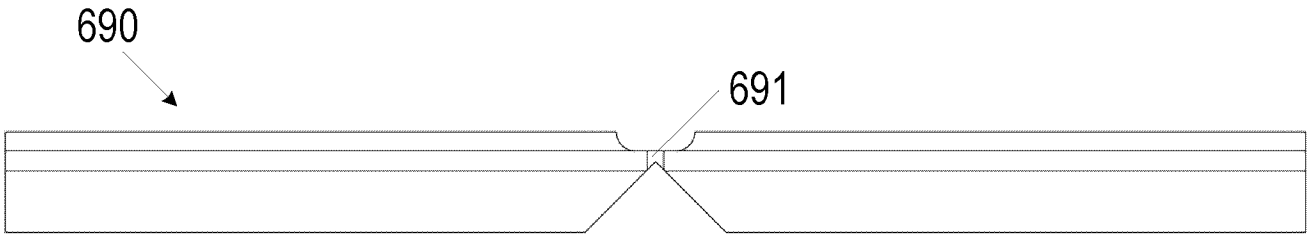
FIGS. 10A to 10C show top, side and rear views, respectively, of a hand-bendable support structure for a coping or skirting system described herein, according to at least one embodiment.
Figure 10B:
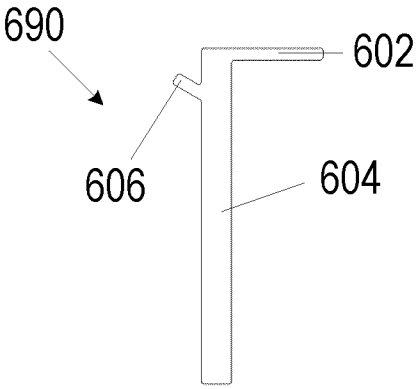
Figure 10C:
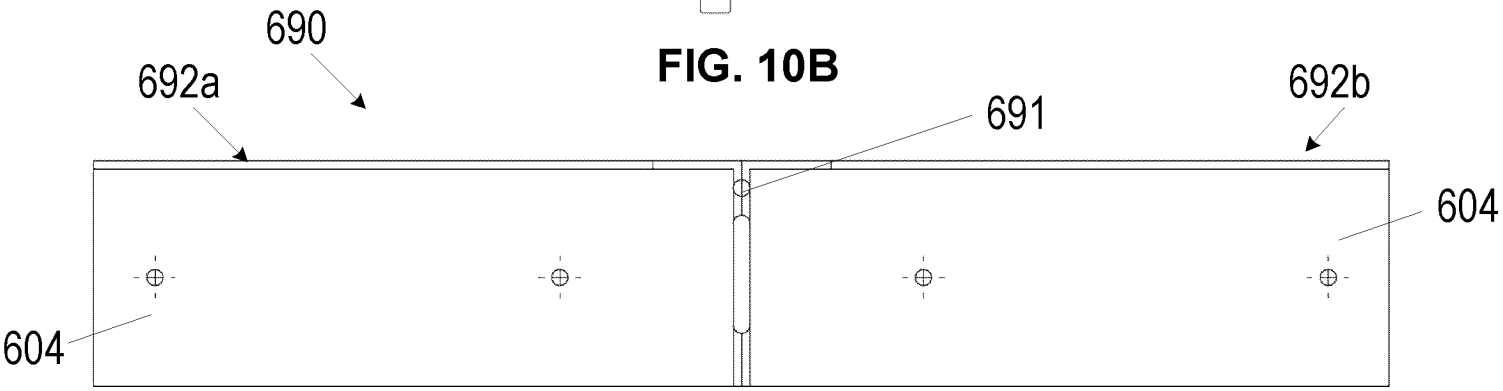

FIG. 10 shows another embodiment of a coping bracket 690. Herein, coping bracket 690 includes all of the features of coping bracket 680 shown in FIGS. 9A to 9C and also includes a bending line 691. A user installing coping bracket 690 may bend the bracket 690 (e.g. by hand) about bending line 691 to provide for the bracket to bend around a corner, for example, to any desired angle.

Bending line 691 divides two portions 692*a* and 692*b* of the coping bracket 690. As shown in FIG. 10B, each portion 692*a* and 692*b* includes the features of coping bracket 680, described above (e.g. coping member 604, alignment tab 602 and coping support lip 606).

Figure 11:
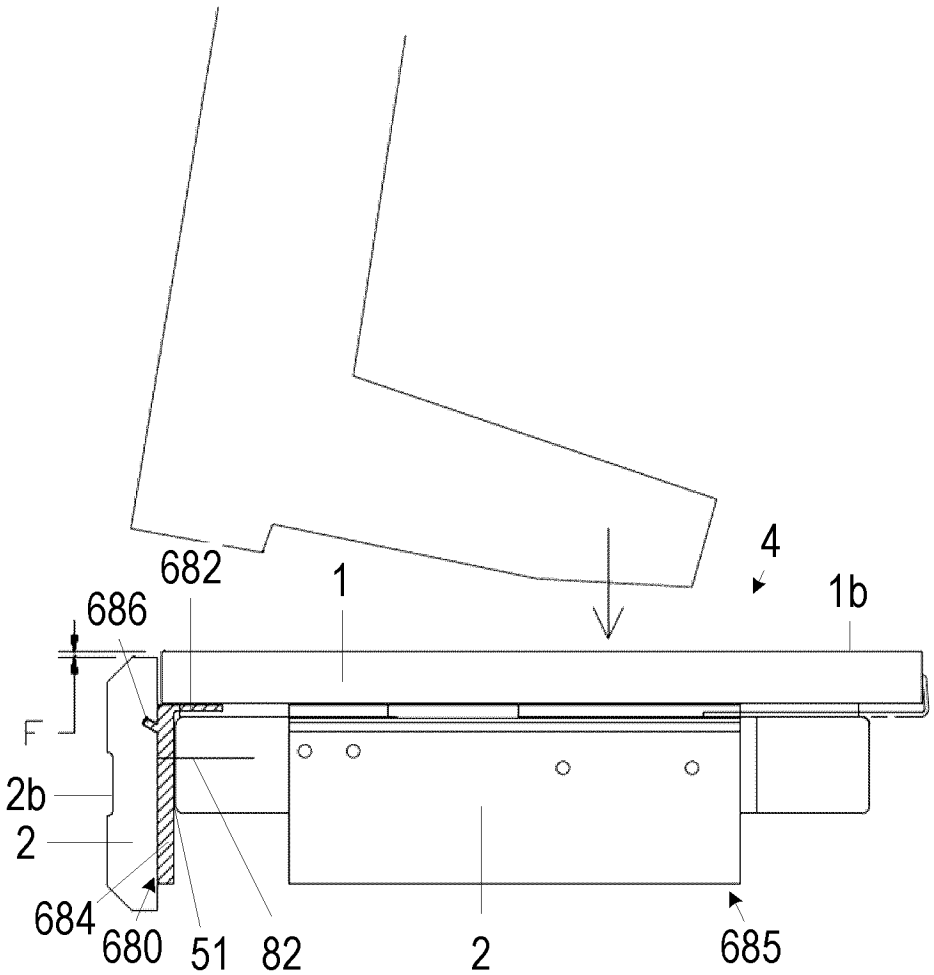
FIG. 11 is an end view of a step tread constructed with the support structures of FIGS. 9A to 9C and 9D to 9F.

Turning now to FIG. 11, illustrated therein is one example use of coping or skirting bracket 680 and coping or skirting bracket 685 on a stair tread. As shown therein, coping or skirting bracket 680 provides for coping tile 2 to be positioned such that a top edge of the coping tile 2 is lower than top surface 1*b* of field tile 1 by a distance F. In some embodiments, distance F may be in a range of about ¼ of an inch to about 1/32 of an inch, or about ⅛ of an inch to about 1/32 of an inch.

Figure 12A:
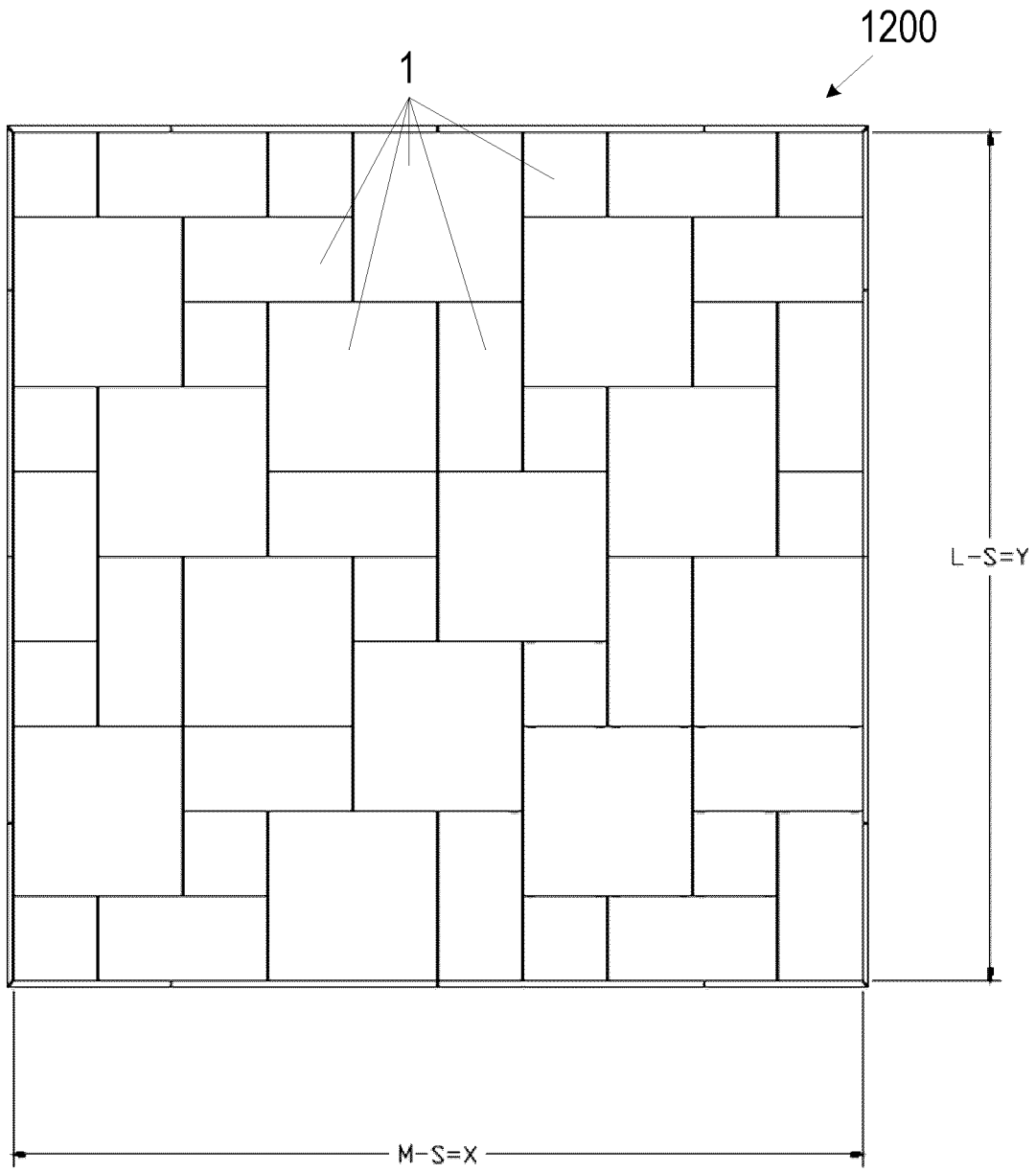
FIG. 12A is a plan view of a floating tile field and modular coping and skirting system employing the coping and skirting system shown in FIGS. 8A to 8C.

FIG. 12A shows a plan view of a field of tiles 1200 that collectively provide an upper surface having a length of distance L measured from an outer surface of the outermost field tiles on opposed ends of the field 1200 and a width of distance M measured from an outer surface of the outermost field tiles on opposed sides of the field 1200. Because of the consistency of the dimensions of the each of the field tiles 1 of field of tiles 1200, the embodiment of field of tiles 1200 shown in FIG. 12A will generally have square corners. To provide for constructing a field of tiles 1200 as shown, it is generally desired to provide a structural base 1201 that also has square corners to properly support the field of tiles 1200 thereon.

Figure 12B:
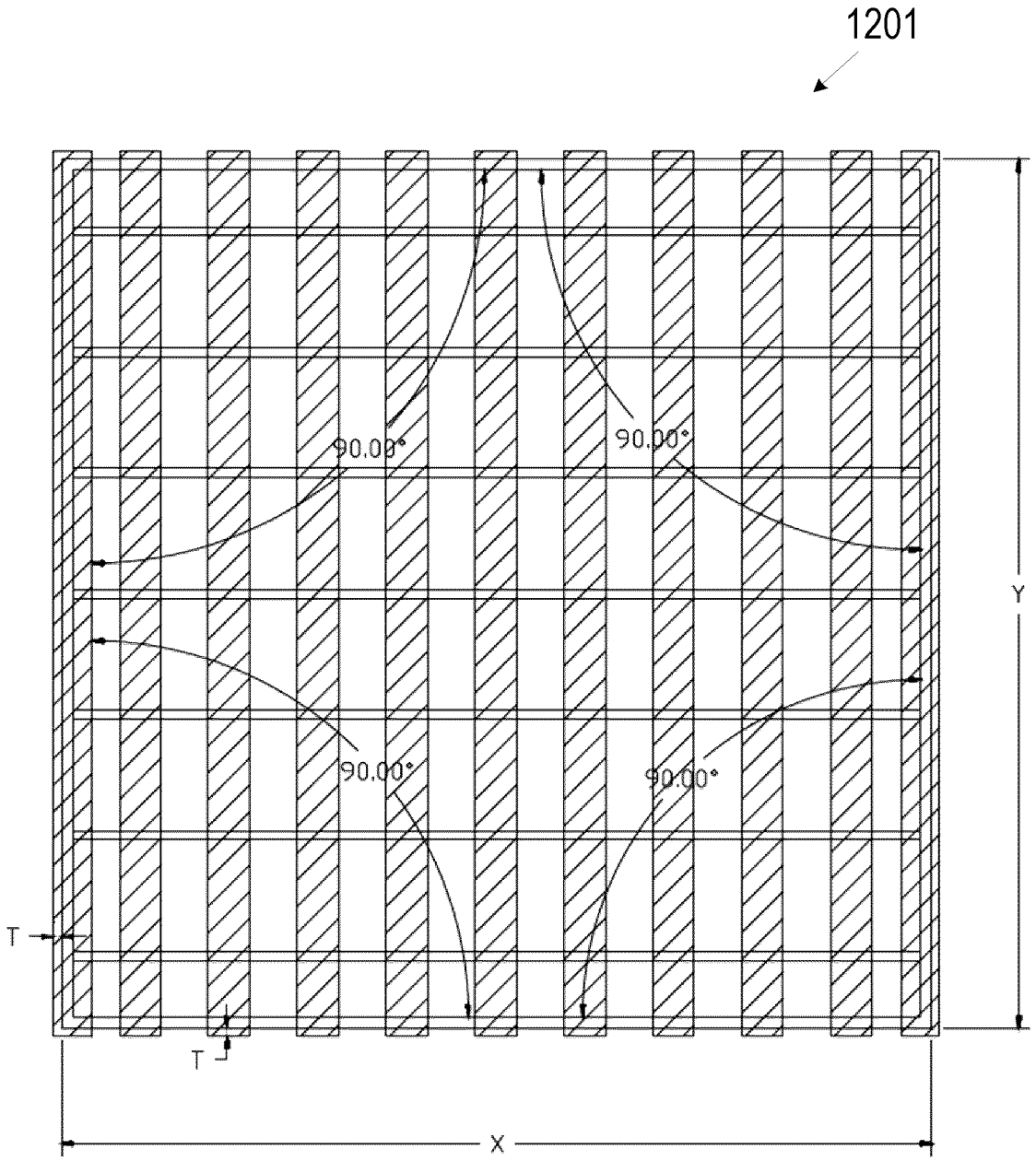
FIG. 12B is a plan view of a deck appropriate for using a modular coping and skirting system described herein.

FIG. 12B shows that structural base 1201 should be square (have 90 degree angles) prior to adding field tiles 1, coping tiles 2 and skirting tiles 3. Structural base 1201 should have a length of distance Y measured from an outer surface (e.g. front surface 51) of structural base 1201 on opposite ends of the structural base 1201 and a width of distance X measured from an outer surface (e.g. front surface 51) of structural base 1201 on opposite sides of the structural base 1201. The difference between length L and length Y is about distance S, which refers to a distance between a front surface of the field tile 1 and a rear surface of the CS bracket 600. Similarly, the difference between width M and width X is also about distance S. In some embodiments, distance S should be in a range of about 0.25 to 1.50 inches depending on the application.

In the event that structural base 1201 is not square (e.g. does not have 90 degree angles), it may be necessary to use CS shims 650 when installing CS brackets 600, for example, to provide a structural base that is square. A method of preparing the structural base and installing a coping and skirting system and field tiles thereon is shown in FIG. 13.

Figure 13:
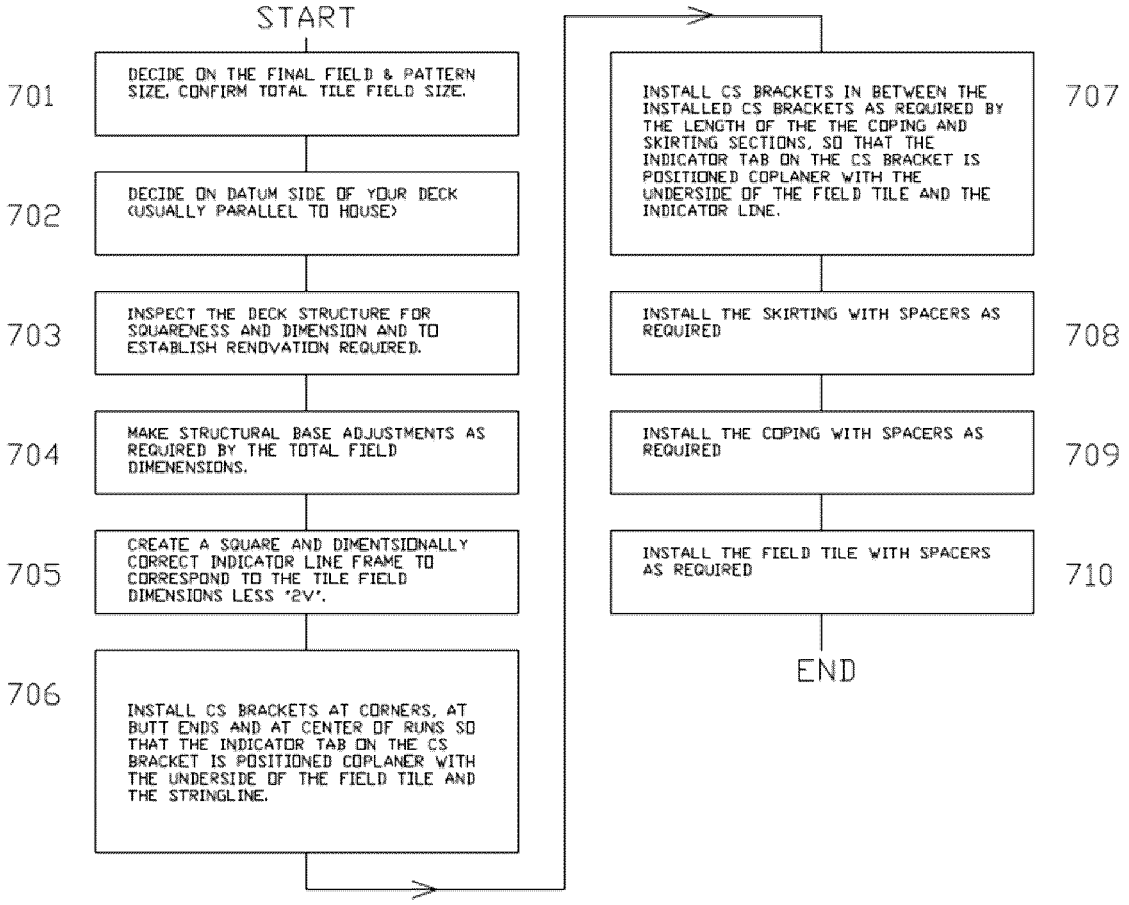
FIG. 13 is a block diagram of a method of installing a modular coping and skirting system and field tiles, according to one embodiment.
Figure 14A:
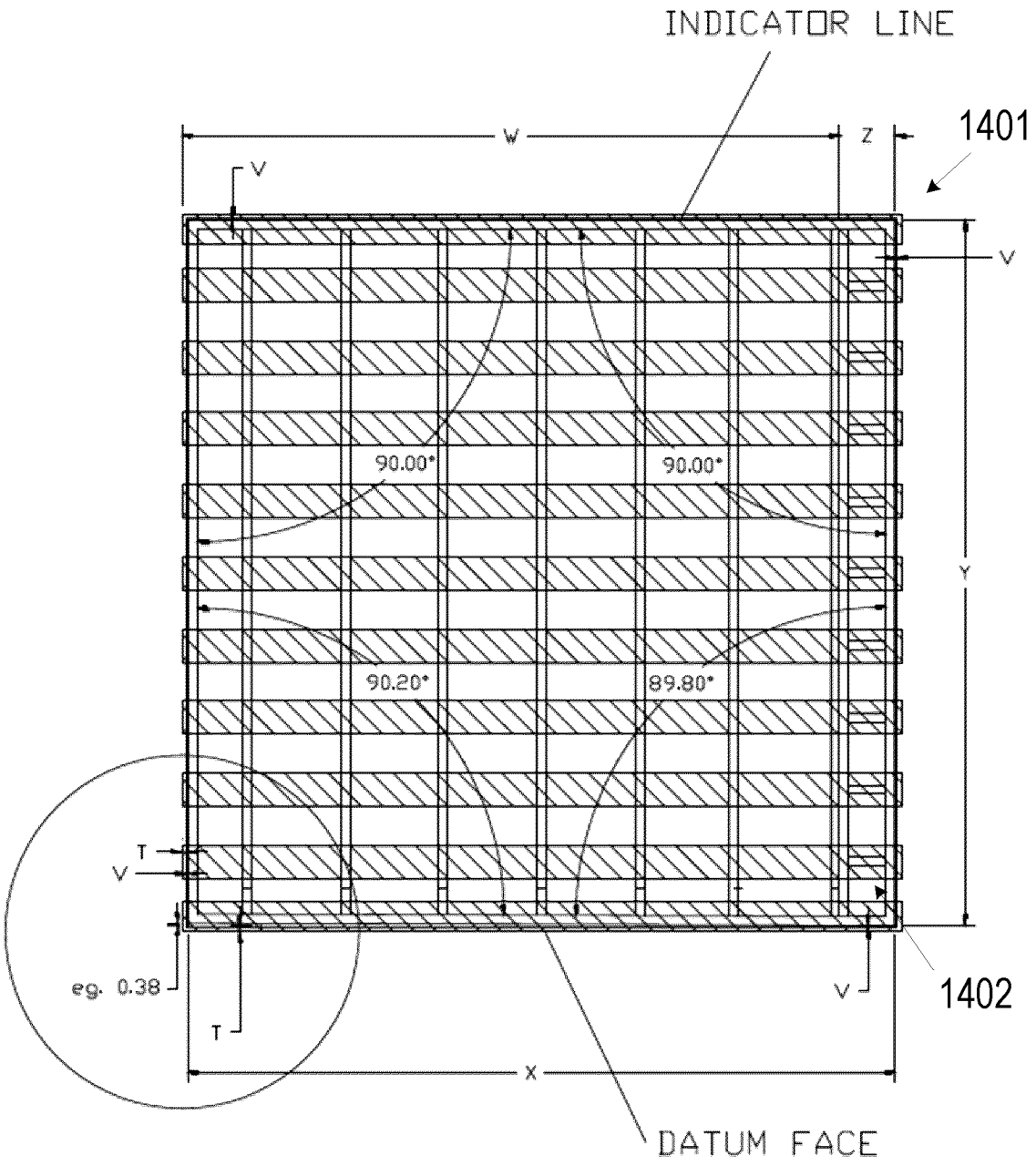
FIG. 14A is a top view of a deck during steps 701-705 of the method of installing a modular coping and skirting system and field tiles of FIG. 13.

As per FIG. 14A and step 701-705 of the method 700 described in FIG. 13, the reference case is a renovation of an existing deck shown in FIG. 14A (having width W and length Y). FIG. 14A shows an example structural base 1401 that is not square and therefore needs to be adjusted in order to apply field tiles 1, coping tiles 2 and skirting tiles 3 thereon. It should be understood that, for illustrative purposes, two common issues to be addressed by an installer are shown therein: 1) building a ladder extension (as may be required to form a structural base that is square) and 2) shimming a side square. These issues may be optional depending on the dimensions of the existing structural base being covered.

At step 701, an installer confirms, based on the total tile field size of the covered structure to be built, the required frame size of the structural base 1401. The required frame size is determined by the formula frame length or width is equal to tile field length or width less two times the frame offset or two times the dimension S as described above.

At step 702, the installer establishes a datum face of the structural base 1401. In some instances, the datum face may be a face that is parallel to but opposite a house wall to which the deck is mounted.

At step 703, the installer inspects the existing structural base 1401. In the example shown in FIG. 14A, the installer finds: 1) that one side of the structural base 1401 is not square (e.g. has two non-90 degree angles) and requires approximately ⅜ inch shimming, for example, to become square over the length Y of the structural base 1401; and 2) that a deck ladder extension 1402 having a width Z and a length Y (extending along the length of the structural base) is required.

At step 704, the installer builds and installs the deck ladder extension 1402 and adjusts perimeter deck boards to maintain dimension T, where dimension T is a distance from a front surface 51 to a vertical projection of the top edge 4*b* of the structural base 4 (see FIG. 8C).

At step 705, the installer installs indicator lines (e.g. chalk, string or laser lines) around a perimeter of the structural base 1401. The indicator lines are square to each other, centered on an upper surface of the structural base 1401, the width between the indicator lines is (X-2V) and the length between the indicator lines is (Y-2V).

Figure 14B:
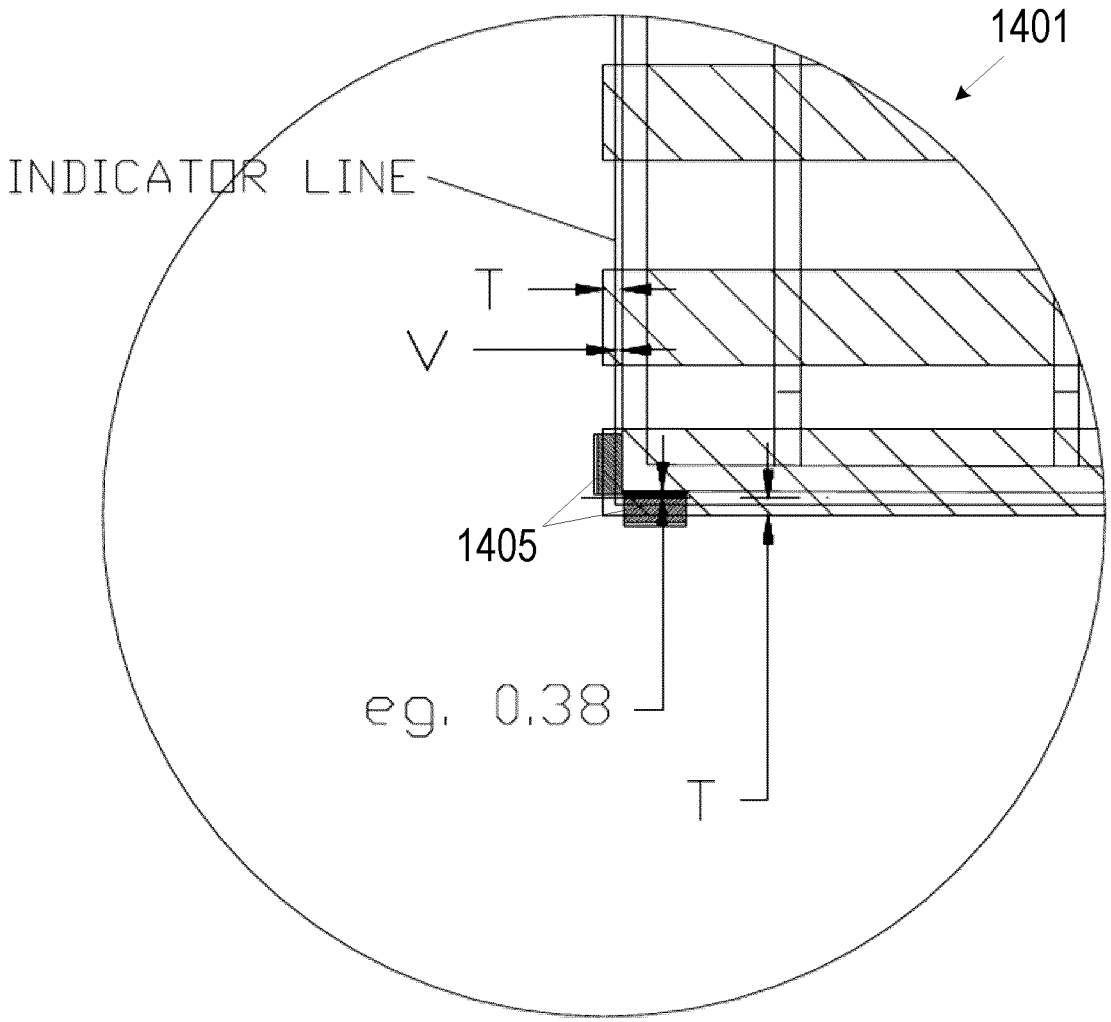
FIG. 14B is a magnified top view of a corner of the deck of FIG. 14A during step 706 of the method of installing a modular coping and skirting system and field tiles of FIG. 13.

As per FIG. 14B and step 706 of the method 700 described in FIG. 13, the installer then installs support structures 1405 (e.g. CS brackets 600) at the corners of the structural base 1401, at the butt ends of the structural base 1401 and/or midway along sides and ends of the structural base 1401 so that an indicator tab of the support structure 1405 (e.g. tab 602 of CS bracket 600) is coplanar with an underside of a field tile 1 and the indicator line on the top of the structural base 1401. Installation of support structures 1405 (e.g. CS bracket 600) of the coping and skirting systems described herein is described above (see FIGS. 8A to 8C).

Figure 14C:
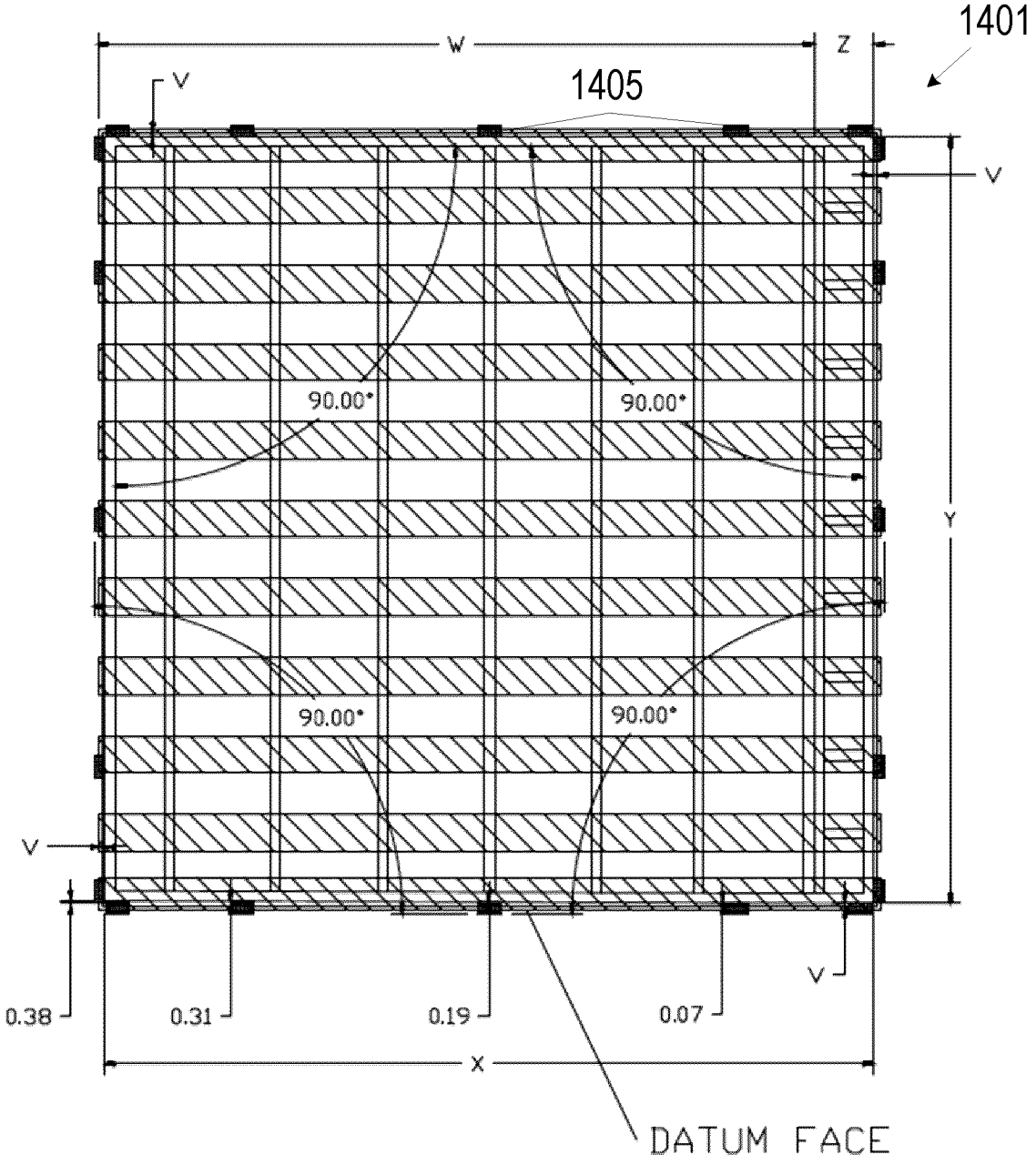
FIG. 14C is a top view the deck of FIG. 14A at the conclusion of steps 706 and 707 of the method of installing a modular coping and skirting system and field tiles of FIG. 13.

As per FIG. 14C and step 707 of the method 700 described in FIG. 13, an the installer can then install support structures 1405 between the support structures 1405 installed at step 706 as determined by the length of the coping tiles 2 and the skirting tiles 3, so that an indicator tab of each of the support structures 1405 is coplanar with the underside of the field tile 1 and aligned with the indicator line on the top of the structural base 1401.

Figure 14D:
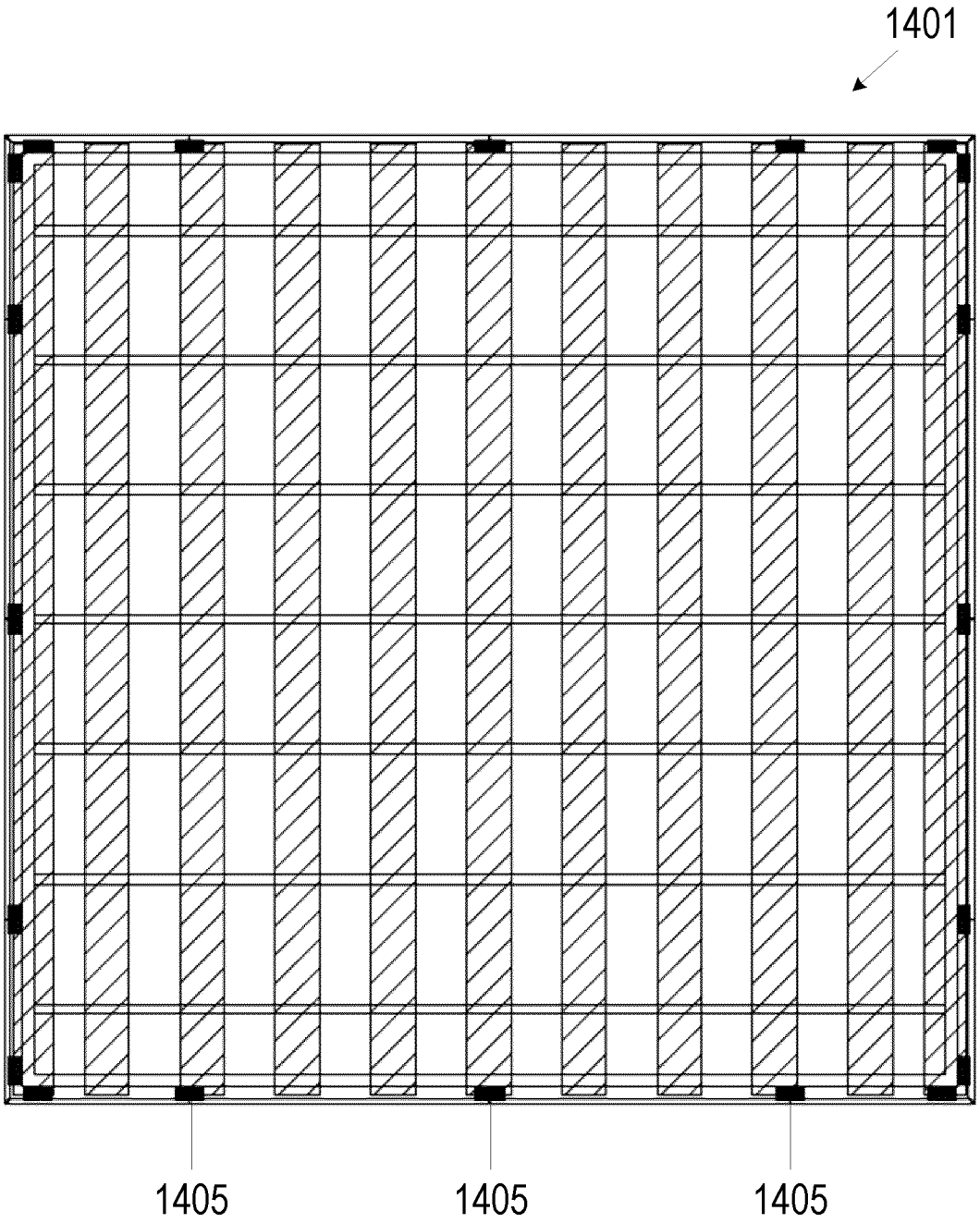
FIG. 14D is a top view of the deck of FIG. 14A at the conclusion of steps 708 and 709 of the method of installing a modular coping and skirting system and field tiles of FIG. 13.

As per FIG. 14D and steps 708 and 709 of the method 700 described in FIG. 13, the installer then fits and installs/connects the skirting tiles and the coping tiles to the support structures utilizing an adhesive (e.g. an ultra-high bond flexible adhesive (UHBFA) with shims in a manner described by FIG. 8C and FIG. 2. For example, the adhesive may be applied to the support structure (e.g. a lip and vertical face of the support structure) and/or to a groove and rear surface of the coping and/or skirting tile.

Figure 14E:
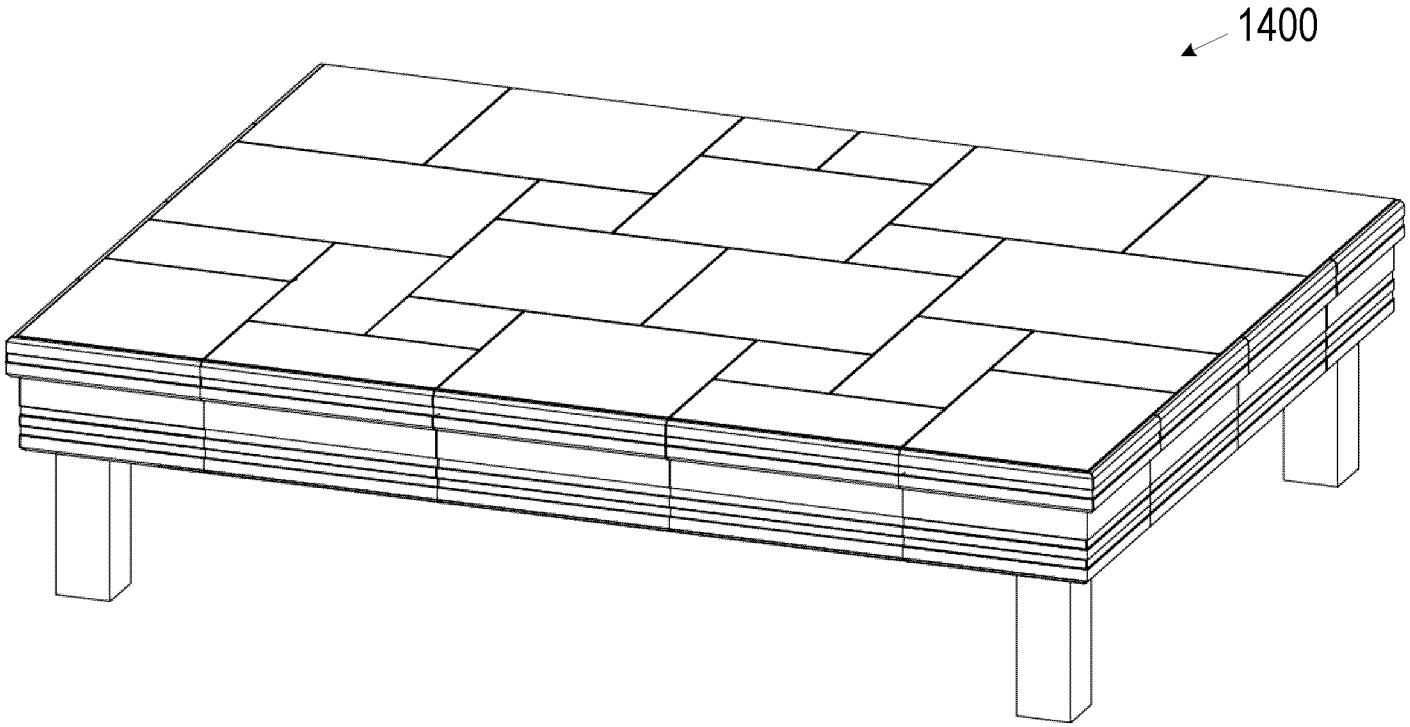
FIG. 14E is an isometric view of a deck at the conclusion of step 710 of the method of installing a modular coping and skirting system and field tiles of FIG. 13.

As per FIG. 14E and step 710 of the method 700 described in FIG. 13, the installer then installs the floating tile field 1400 in a manner described by FIG. 2.

Figure 15A:
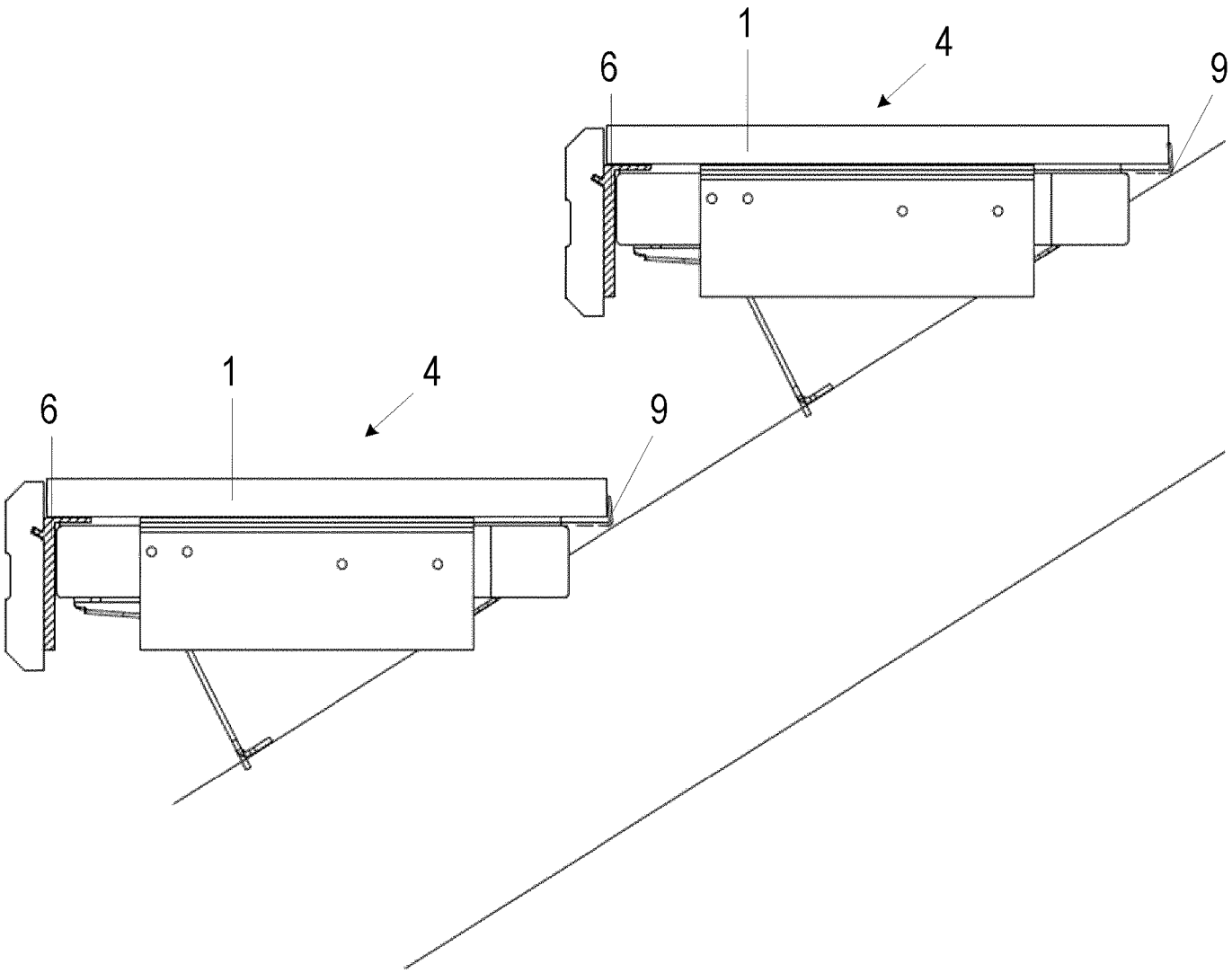
FIG. 15A is side cross-section view of a stair stringer showing coping tiles used to retain floating floor tiles on a step.
Figure 15C:
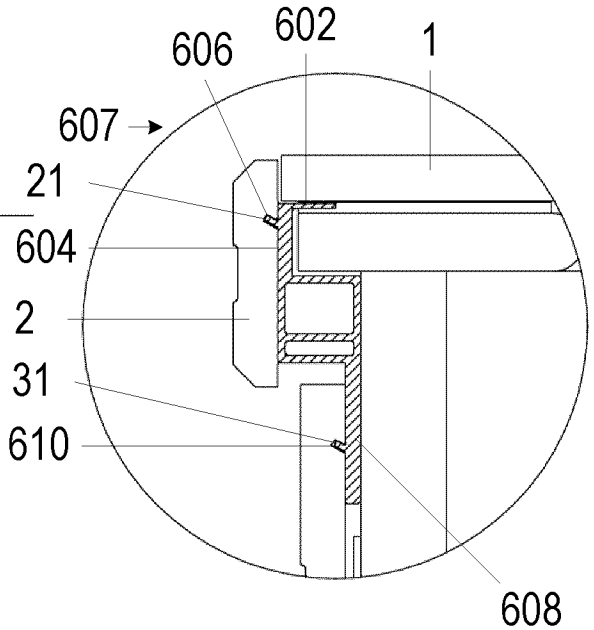
FIG. 15C is a magnified view of portion C of FIG. 15B.
Figure 15B:
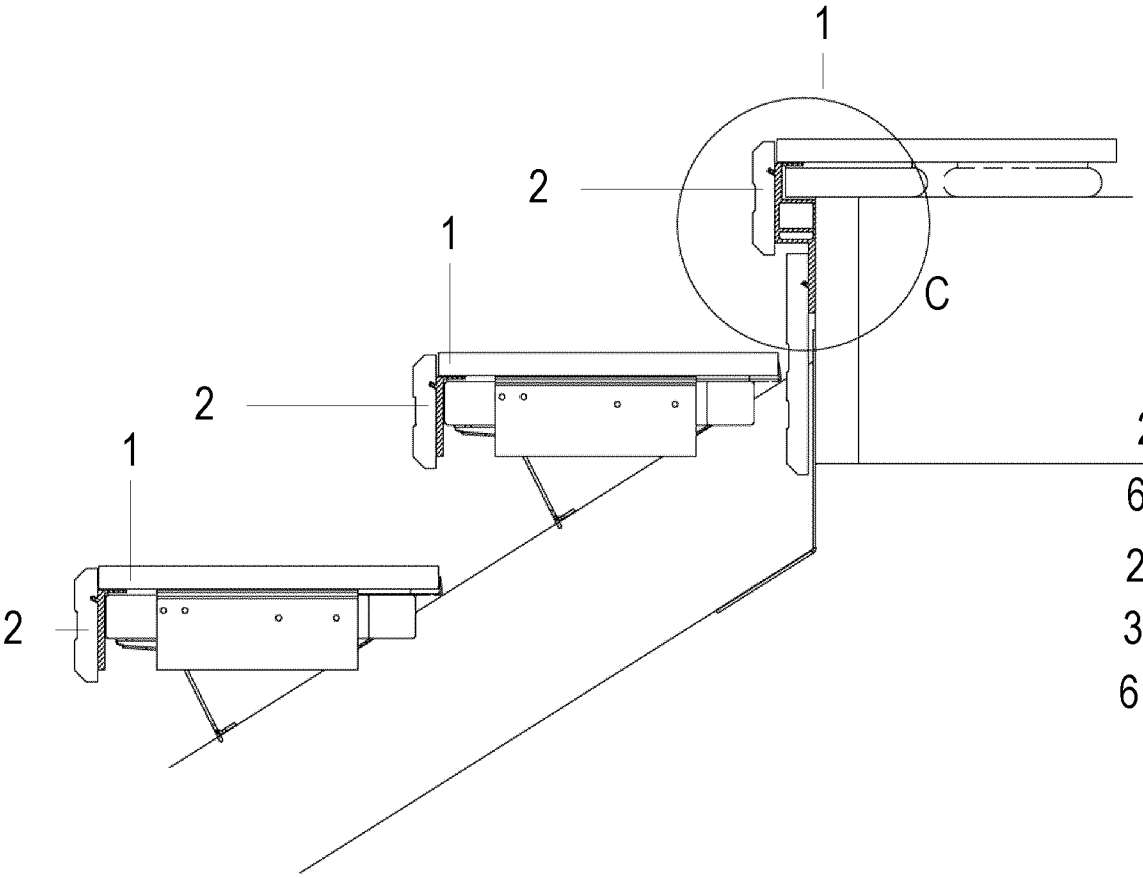
FIG. 15B is side cross-section view of a stair assembly connected to a structural base covered in floating tiles and a modular coping and skirting system according to one of the embodiments described herein.

FIGS. 15A and 15B show two structural bases (e.g. stair treads) 4 that are connected to a stair system and covered with field tiles 1. To pass building codes, stair rise, run, overlap and treads need to be built with very particular dimensioning and geometric relations. Given these technical requirements, in this embodiment, coping bracket 6 that is connected to structural base 4 provides for clearance for the installation of floating tile 1 on the lower step while maintaining the dimensional integrity required to pass building codes. In this embodiment, to maintain this dimensional integrity on the first step, FIG. 15A shows the absence of backside perimeter coping tile 2 and the perimeter for retaining the floating tile 1 on the top step is completed by a retainer bracket 9. Retainer bracket 9 is directly affixed to stair tread 4 and configured to retain field tiles 1 thereon.

Referring to FIGS. 15B and 15C, groove 21 on coping tiles 2 provides a channel for coping tiles 2 to be able to slide horizontally along lip 606 of coping bracket 600. Similarly, groove 31 provides a channel for skirting tiles 3 to slide back and forth along lip 610 of bracket 600. These sliding relationships may provide for fitting and finishing the installation of the coping tiles 2 and skirting tiles 3 in an aesthetically pleasing and straightforward manner. Given these sliding relationships and for flexibility in the modular coping and skirting systems described herein, coping tiles 2 and the skirting tiles 3 are generally described as being independent parts. Further, coping tiles 2 and the skirting tiles 3 being independent may provide for an installer to mix finishes (e.g. colors or patterns thereon) for aesthetic purposes.

Figure 16A:
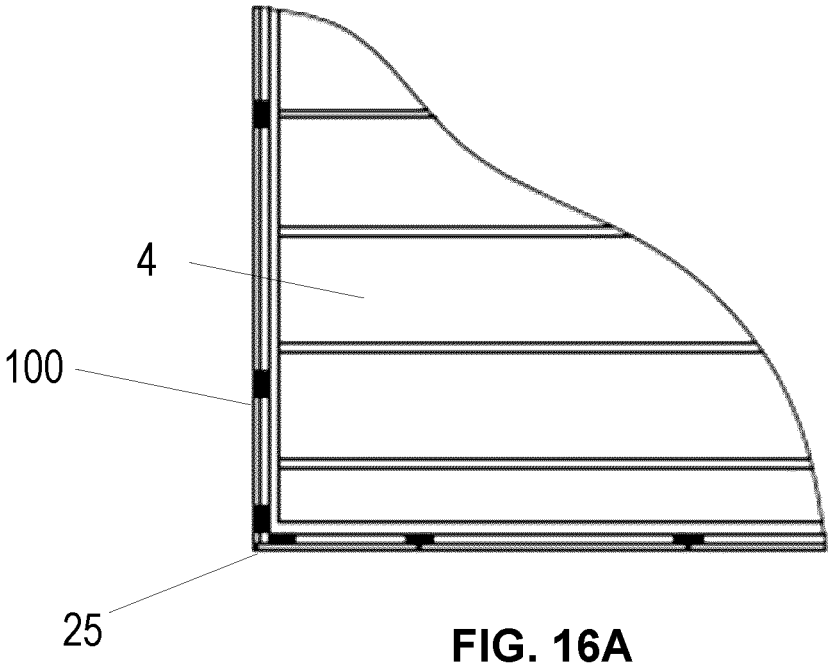
FIG. 16A is top view of a structural base to be covered in a floating tile system and a modular coping and skirting system according to one of the embodiments described herein having one or more support structures installed and at least one angle of 90 degrees.
Figure 16B:
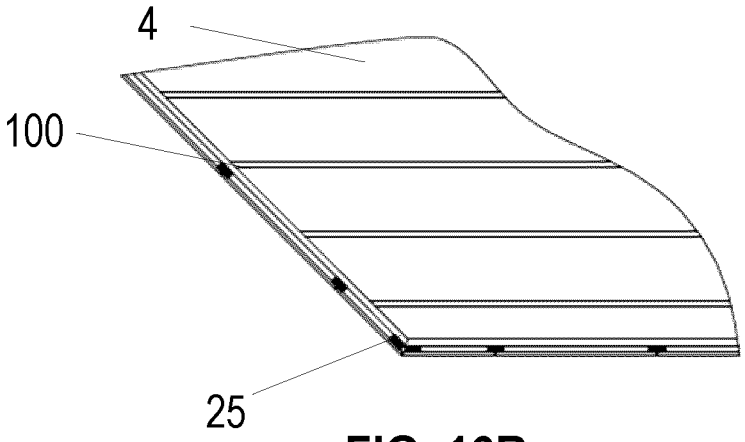
FIG. 16B is top view of a structural base to be covered in a floating tile system and a modular coping and skirting system according to one of the embodiments described herein having one or more support structures installed and at least one non-90 degree angle.

FIGS. 16A and 16B are a top views of a structural base 4 and the modular coping and skirting system 100 showing the corners 25, where the skirting tiles and coping tiles meet at different angles as defined by the geometry of structure 4. Precision is required in properly mating the corner 25 surfaces of each of the skirting tiles and coping tiles. The sliding feature described above may provide for finishing and installation of the coping tiles and skirting tiles in an aesthetically pleasing and straightforward manner.

Figure 17B:
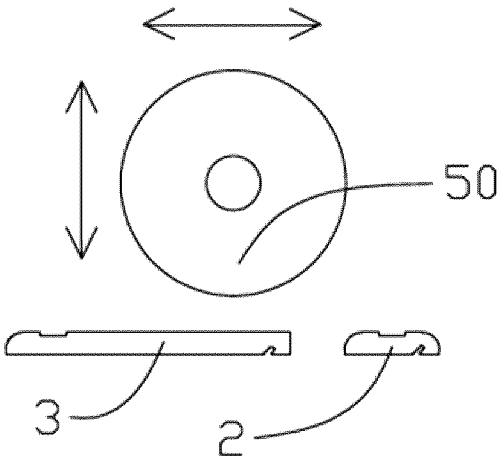
FIG. 17B is a schematic side view of a diamond blade of a miter saw in relation to coping tile and skirting tile.
Figure 17A:
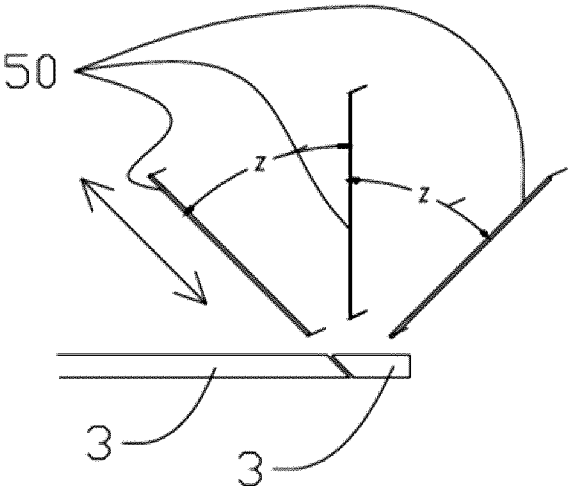
FIG. 17A is a schematic front view of a diamond blade of a miter saw cutting a skirting tile at an angle.
Figure 18A:
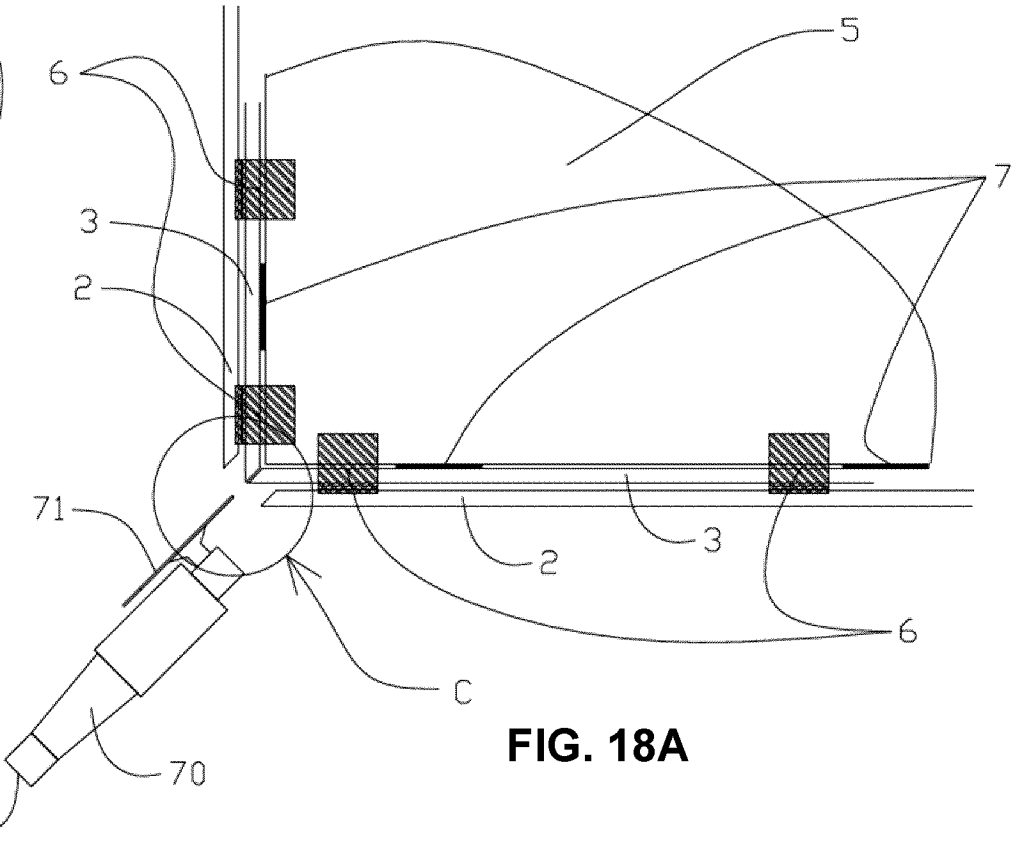
FIG. 18A is top view depicting an electric hand grinder fine tuning and fitting the angle cut during installation of a coping and skirting system according to one of the embodiments described herein.
Figure 18B:
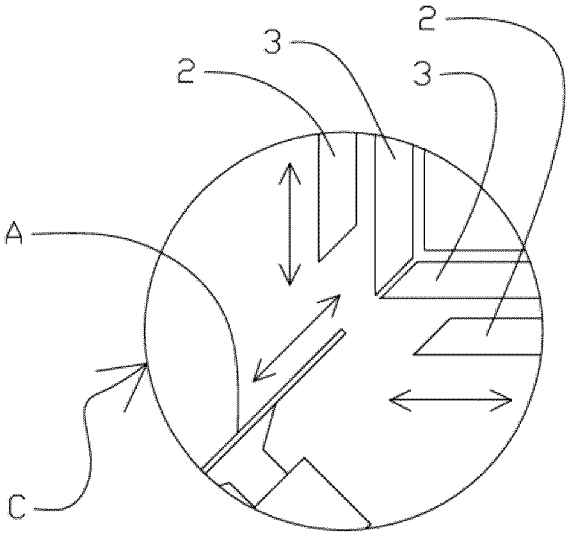
FIG. 18B is magnified view of portion C of FIG. 18A showing the electric hand grinder fine tuning and fitting the angle cut on a mineral based coping and skirting system.

FIG. 17A is front view of a miter saw fitted with a diamond blade cutting a skirting tile 3 set at an angle at Z degrees. FIG. 17B is a side view of the same miter saw fitted with a diamond blade 50 in relation to a coping tiles 2 and skirting tiles 3. As illustrated by FIGS. 11A and 8B, the first step in fitting and finishing a coping tile 2 corner or skirting tile 3 corner is to cut ½ of the required approximate angle utilizing a miter saw fitted with a diamond blade 50. Once the corresponding left and right cuts are made, the coping tiles 2 or skirting tiles 3 (as the case may be) are hung on the respective brackets 6 or 7 and butted together at the corners as illustrated in FIGS. 18A and 18B. FIGS. 18A and 18B also illustrate how an installer can utilize a hand-held angle grinder 70 fitted with a diamond blade 70*a* to systematically and iteratively utilize the sliding back and forth feature of the coping tiles 2 or skirting tiles 3 (as the case may be) to create a perfectly matched corner.

Although described above for use with mineral-based tiles, it should be noted that the modular skirting and coping systems 100 described herein, including the CS bracket 680, may be used with other floating tile systems including but not limited to mineral tiles.

While the applicant's teachings described herein are in conjunction with various embodiments for illustrative purposes, it is not intended that the applicant's teachings be limited to such embodiments as the embodiments described herein are intended to be examples. On the contrary, the applicant's teachings described and illustrated herein encompass various alternatives, modifications, and equivalents, without departing from the embodiments described herein, the general scope of which is defined in the appended claims.

What is claimed is:

1. A system for mounting a coping tile on a structural base, the system including:

a coping bracket configured to be mounted on a top surface of the structural base, the coping bracket having:

a coping support member;

a coping support lip extending upwardly and outwardly from a first position on the front surface of the coping support member in a direction away from a front surface of the structural base, the coping support lip being configured to support the coping tile in front of the front surface of the structural base; and an alignment tab extending rearwardly from a second position on the rear surface of the coping support member over the top surface of the structural base to receive a fastener to mount the coping bracket on the structural base when the coping support member is spaced apart from the front surface of the structural base, the alignment tab providing for a top surface of the coping tile supported on the coping support lip to be level with or below a top surface of a field tile positioned on a top surface of the alignment tab, the first position being below the second position.

2. The system of claim 1, wherein the coping support lip is configured to rest within a groove in a rear surface of the coping tile to support the coping tile on the structural base.

3. The system of claim 2, wherein the direction that the coping support lip extends away from the front surface of the structural base is upward and outward from the front surface of the structural base.

4. The system of claim 1, wherein the alignment tab has a first end that meets the rear surface of the coping support member and a second end that is spaced apart from the first end in a direction that is orthogonal to an axis of the coping support member.

5. The system of claim 4, wherein the alignment tab is planar to be positioned between a bottom surface of the field tile and the top surface of the structural base.

6. The system of claim 1, further comprising an adhesive to retain the coping tile on the coping bracket.

7. The system of claim 1 further comprising a skirting bracket, the skirting bracket being a separate component from the coping bracket.

8. A system for mounting a coping tile on a structural base, the system including:

a coping bracket configured to be mounted on a top surface of the structural base, the coping bracket having:

a coping support member;

a coping support lip extending from a front surface of the coping support member in a direction away from a front surface of the structural base, the coping support lip being configured to support the coping tile in front of the front surface of the structural base; and an alignment tab extending from the coping support member over the top surface of the structural base to receive a fastener to mount the coping bracket on the structural base when the coping support member is spaced apart from the front surface of the structural base, the alignment tab providing for a top surface of the coping tile supported on the coping support lip to be level with or below a top surface of a field tile positioned on a top surface of the alignment tab; and a skirting bracket, the skirting bracket being a separate component from the coping bracket; and a skirting tile, wherein the skirting bracket is configured to support the skirting tile on the structural base.

9. The system of claim 8, wherein the skirting bracket includes a skirting support lip configured to rest within a groove in a rear surface of the skirting tile to support the skirting tile on the structural base.

10. The system of claim 9, wherein the skirting support lip extends upwardly and outwardly in a direction away from the front surface of the structural base.

11. The system of claim 9, wherein the skirting support lip is positioned below the coping support lip.

12. The system of claim 7, wherein a front face of the coping bracket is laterally spaced apart from a front face of the skirting bracket.

13. The system of claim 9, wherein the coping support lip is vertically spaced above the skirting support lip.

14. A method of installing a coping system on a structural base, the method comprising:

mounting a coping bracket on a top surface of the structural base, the coping bracket having:

a coping support member;

a coping support lip extending from a front surface of the coping support member in a direction away from a front surface of the structural base, the coping support lip being configured to support a coping tile in front of the front surface of the structural base; and an alignment tab extending from the coping support member over the top surface of the structural base to receive a fastener to mount the coping bracket on the structural base when the coping support member is spaced apart from the front surface of the structural base, the alignment tab providing for a top surface of the coping tile supported on the coping support lip to be level with or below a top surface of a field tile positioned on a top surface of the alignment tab;

installing the coping tile on the coping bracket; and mounting a skirting bracket on the structural base and installing a skirting tile on the skirting bracket.

15. The method of claim 14, wherein mounting the coping bracket on the structural base includes:

marking an indicator line on the top surface of the structural base;

aligning the alignment tab of the coping bracket with the indicator line; and mounting the coping bracket to the structural base when the alignment tab of the coping bracket is aligned with the indicator line and the coping support member is spaced apart from the front surface of the structural base.

16. The method of claim 14, wherein installing the coping tile on the coping bracket includes inserting the coping support lip of the coping bracket into a groove extending inwardly from a rear surface of the coping tile.

17. A system for mounting a coping tile on a structural base, the system including:

a coping bracket configured to be mounted on a top surface of the structural base, the coping bracket having:

a coping support member;

a coping support lip extending from a front surface of the coping support member in a direction away from a front surface of the structural base, the coping support lip being configured to support the coping tile in front of the front surface of the structural base; and an alignment tab extending from the coping support member over the top surface of the structural base from a top edge of the coping support member to receive a fastener to mount the coping bracket on the structural base when the coping support member is spaced apart from the front surface of the structural base, the alignment tab providing for a top surface of the coping tile supported on the coping support lip to be level with or below a top surface of a field tile positioned on a top surface of the alignment tab.

18. The system of claim 17, wherein the alignment tab has a first end that meets the rear surface of the coping support member and a second end that is spaced apart from the first end in a direction that is orthogonal to an axis of the coping support member.

19. The system of claim 17, wherein the alignment tab is planar to be positioned between a bottom surface of the field tile and the top surface of the structural base.

* * * * *